US009958170B2

(12) United States Patent
Yamashita et al.

(10) Patent No.: US 9,958,170 B2
(45) Date of Patent: May 1, 2018

(54) AIR CONDITIONING APPARATUS

(75) Inventors: Koji Yamashita, Tokyo (JP); Hiroyuki Morimoto, Tokyo (JP); Yuji Motomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 936 days.

(21) Appl. No.: 13/499,878

(22) PCT Filed: Oct. 22, 2009

(86) PCT No.: PCT/JP2009/068162

§ 371 (c)(1),
(2), (4) Date: Apr. 2, 2012

(87) PCT Pub. No.: WO2011/048679

PCT Pub. Date: Apr. 28, 2011

(65) Prior Publication Data

US 2012/0198874 A1 Aug. 9, 2012

(51) Int. Cl.
*F25B 7/00* (2006.01)
*F25B 1/00* (2006.01)
(Continued)

(52) U.S. Cl.
CPC ..... *F24F 3/06* (2013.01); *F24F 3/065* (2013.01); *F24F 11/83* (2018.01); *F25B 25/005* (2013.01);
(Continued)

(58) Field of Classification Search
CPC . F24F 3/06; F24F 3/065; F24F 25/005; F25B 25/005; F25B 7/00; F25B 2500/07;
(Continued)

(56) References Cited

U.S. PATENT DOCUMENTS 4,193,270 A * 3/1980 Scott ..... F25B 1/00 62/175
5,065,591 A * 11/1991 Shaw ..... F25B 5/02 62/175
(Continued)

FOREIGN PATENT DOCUMENTS

CN 1699890 A 11/2005
CN 1786603 A 6/2006
(Continued)

OTHER PUBLICATIONS

International Search Report (PCT/ISA/210) dated Dec. 28, 2009, by Japanese Patent Office as the International Searching Authority for International Application No. PCT/JP2009/068162.
(Continued)

*Primary Examiner* — Ned Landrum
*Assistant Examiner* — Daniel C Comings
(74) *Attorney, Agent, or Firm* — Buchanan Ingersoll & Rooney PC

(57) ABSTRACT

An air-conditioning apparatus includes indoor units including a plurality of use side heat exchangers that exchange heat between air and a heat medium, and a heat medium relay unit having a plurality of heat exchangers related to heat medium. A plurality of pumps deliver the heat medium involved in heating or cooling performed by the plurality of heat exchangers related to heat medium to each passage and circulate the heat medium. A plurality of heat medium flow switching devices perform switching so that the heat medium from a selected passage flows into and flows out of each use side heat exchanger. An expansion tank is connected to a passage alleviates a pressure change caused by a volumetric change of the heat medium, and a pressure equalizing pipe connects each inlet passage or each outlet passage of the heat medium sending devices.

10 Claims, 10 Drawing Sheets

(51) Int. Cl.

| | |
|---|---|
| ***F25B 49/00*** | (2006.01) |
| ***F25B 1/10*** | (2006.01) |
| ***F25B 39/04*** | (2006.01) |
| ***F24F 3/06*** | (2006.01) |
| ***F25B 25/00*** | (2006.01) |
| *F25B 13/00* | (2006.01) |
| *F25B 45/00* | (2006.01) |

(52) U.S. Cl.

CPC ..... *F25B 7/00* (2013.01); *F25B 13/00* (2013.01); *F25B 45/00* (2013.01); *F25B 2313/006* (2013.01); *F25B 2313/0231* (2013.01); *F25B 2313/02732* (2013.01); *F25B 2313/02741* (2013.01); *F25B 2500/07* (2013.01); *F25B 2600/027* (2013.01); *F25B 2600/0271* (2013.01); *F25B 2600/0272* (2013.01)

(58) Field of Classification Search

CPC ..... F25B 2600/027; F25B 2600/0271; F25B 2600/0272; F25F 3/00; F25F 3/06; F25F 3/065

USPC ..... 62/175, 324.1, 335, 509, 510, 228.3; 417/3

See application file for complete search history.

(56) References Cited

U.S. PATENT DOCUMENTS

| | | | | |
|---|---|---|---|---|
| 5,996,363 | A * | 12/1999 | Kurachi | F04B 39/0207 417/372 |
| 6,126,080 | A * | 10/2000 | Wada | 236/51 |
| 6,845,627 | B1 * | 1/2005 | Buck | 62/185 |
| 2002/0073721 | A1 * | 6/2002 | Seo | F25B 49/022 62/228.3 |
| 2006/0117770 | A1 | 6/2006 | Park et al. | |
| 2009/0020620 | A1 | 1/2009 | Douarre | |
| 2009/0255997 | A1 * | 10/2009 | Goldmann et al. | 236/1 B |

FOREIGN PATENT DOCUMENTS

| | | | |
|---|---|---|---|
| EP | 1 700 068 | A1 | 9/2006 |
| JP | 57-024478 | A | 2/1982 |
| JP | 4-1372 | U | 1/1992 |
| JP | 05-248731 | A | 9/1993 |
| JP | 5-280818 | A | 10/1993 |
| JP | 6-147677 | A | 5/1994 |
| JP | 10-266855 | A | 10/1998 |
| JP | 11-118212 | A | 4/1999 |
| JP | 2000-088429 | A | 3/2000 |
| JP | 2001-289465 | A | 10/2001 |
| JP | 2003-343936 | A | 12/2003 |
| JP | 2004-053069 | A | 2/2004 |
| JP | 2004-226015 | A | 8/2004 |
| JP | 2005-140444 | A | 6/2005 |
| JP | 2008-215647 | A | 9/2008 |
| JP | 2009-525914 | A | 7/2009 |
| WO | 2005/047784 | A1 | 5/2005 |

OTHER PUBLICATIONS

Office Action dated May 30, 2014, by the Chinese Patent Office in corresponding Chinese Patent Application No. 200980162047.5, and an English Translation of the Office Action. (16 pages).

Office Action (Notice of Reasons for Rejection) dated May 14, 2013, issued in corresponding Japanese Patent Application No. 2011-537060, and an English Translation of the Japanese Office Action. (5 pgs.).

Office Action (Notification of the First Office Action) dated Dec. 16, 2013, by the Chinese Patent Office in corresponding Chinese Patent Application No. 200980162047.5, and an English Translation of the Office Action. (16 pages).

Office Action (Notice of Reasons for Refusal) dated Jan. 7, 2014, by the Japanese Patent Office in corresponding Japanese Patent Application No. 2011-537060, and an English Translation of the Office Action. (5 pages).

Extended European Search Report dated Jul. 20, 2016, issued by the European Patent Office in corresponding European Application No. 09850577.9. (9 pages).

* cited by examiner

AIR CONDITIONING APPARATUS

TECHNICAL FIELD

The present invention relates to an air-conditioning apparatus that is applied to, for example, a multi-air-conditioning apparatus for a building.

BACKGROUND ART

In an air-conditioning apparatus, such as a multi-air-conditioning apparatus for a building, refrigerant is circulated between an outdoor unit, functioning as a heat source unit, disposed outside a structure, for example, and an indoor unit disposed inside an indoor space of the structure. The refrigerant transfers heat or removes heat to heat or cool air, thus heating or cooling a conditioned space through the heated or cooled air. As regards the refrigerant, for example, an HFC (hydrofluorocarbon) refrigerant is often used. An air-conditioning apparatus using a natural refrigerant, such as carbon dioxide ($CO_2$), is also proposed.

Furthermore, in an air-conditioning apparatus called a chiller, cooling energy or heating energy is produced in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

Moreover, an air-conditioning apparatus called a waste heat recovery chiller is constructed such that a heat source unit is connected to each indoor unit through four water pipes arranged therebetween and, for example, cooled water and heated water are simultaneously supplied so that cooling or heating can be arbitrarily selected in the indoor unit (refer to Patent Literature 2, for example).

In addition, an air-conditioning apparatus is constructed such that a heat exchanger for a primary refrigerant and a secondary refrigerant is disposed near each indoor unit to carry the secondary refrigerant to the indoor unit (refer to Patent Literature 3, for example).

Furthermore, an air-conditioning apparatus is constructed such that an outdoor unit is connected to each branching unit including a heat exchanger through two pipes to carry a secondary refrigerant to an indoor unit (refer to Patent Literature 4, for example).

CITATION LIST

Patent Literature

Patent Literature 1: Japanese Unexamined Patent Application Publication No. 2005-140444 (Page 4, FIG. 1, for example)

Patent Literature 2: Japanese Unexamined Patent Application Publication No. 5-280818 (Pages 4 and 5, FIG. 1, for example)

Patent Literature 3: Japanese Unexamined Patent Application Publication No. 2001-289465 (Pages 5 to 8, FIGS. 1 and 2, for example)

Patent Literature 4: Japanese Unexamined Patent Application Publication No. 2003-343936 (Page 5, FIG. 1)

SUMMARY OF INVENTION

Technical Problem

In an air-conditioning apparatus of a related are, such as a multi-air-conditioning apparatus for a building, a refrigerant may leak into, for example, an indoor space because the refrigerant is circulated up to an indoor unit. On the other hand, in the air-conditioning apparatuses disclosed in Patent Literature 1 and Patent Literature 2, the refrigerant does not pass through the indoor unit. It is however required to heat or cool a heat medium in a heat source unit disposed outside a structure and carry it to the indoor unit in the air-conditioning apparatuses disclosed in Patent Literature 1 and Patent Literature 2. Accordingly, a circulation path for the heat medium is long. In this case, to carry heat for a predetermined heating or cooling work using the heat medium, the amount of energy consumed for, for example, conveyance power is larger than that of the refrigerant. As the circulation path is longer, therefore, the conveyance power markedly increases. This indicates that energy saving is achieved as long as the circulation of the heat medium can be properly controlled in an air-conditioning apparatus.

In the air-conditioning apparatus disclosed in Patent Literature 2, the four pipes have to be arranged to connect each indoor space to an outdoor unit so that cooling or heating can be selected in each indoor unit. Disadvantageously, there is little ease of construction. In the air-conditioning apparatus disclosed in Patent Literature 3, a secondary medium circulating device, such as a pump, has to be provided to each indoor unit. Disadvantageously, the cost of such a system is high and also noise is large. This apparatus is not practical. In addition, since the heat exchanger is placed near each indoor unit, the risk of leakage of the refrigerant into a place near an indoor space cannot be removed.

In the air-conditioning apparatus disclosed in Patent Literature 4, a primary refrigerant that has been subjected to heat exchange flows into the same passage as that of the primary refrigerant to be subjected to heat exchange. In the case in which a plurality of indoor units is connected, it is difficult for each indoor unit to exhibit their maximum capacity. Such a configuration wastes energy. Furthermore, each branching unit is connected to an extension pipe through two pipes for cooling and two pipes for heating, i.e., four pipes in total. Consequently, this configuration is similar to that of a system in which the outdoor unit is connected to each branching unit through four pipes. Accordingly, there is little ease of construction in such a system.

The present invention provides an air-conditioning apparatus capable of absorbing changing volume, which is particularly induced by temperature, of heat medium in pipes, and provides an air-conditioning apparatus that is safe, having high reliability, and can save energy.

Solution to Problem

An air-conditioning apparatus according to the present invention has indoor units including a plurality of use side heat exchangers that exchange heat between air with which heat is to be exchanged and a heat medium; a heat medium relay unit including a plurality of heating/cooling units that heat or cool the heat medium, a plurality of heat medium sending devices that deliver the heat medium involved in heating or cooling performed by the heating/cooling units to a plurality of passages respectively and circulate the heat medium, and a plurality of heat medium flow switching devices that each perform switching so that one or a plurality of heat medium in the plurality of passages flow into and flow out of the corresponding use side heat exchanger; a pressure absorber that connects to one of the passages, the pressure absorber alleviating a pressure change caused by a volumetric change of the heat medium; and a pressure equalizing pipe that connects inlet passages or outlet passages of the heat medium sending devices.

Advantageous Effects of Invention

The air-conditioning apparatus according to the invention is provided with a pressure absorber that absorbs an expansion force, which varies by temperature, of a heat medium and thus is capable of suppressing the pressure change in the pipes that is caused by temperature-induced volumetric change of the heat medium conveyed in the pipes, preventing damage and the like of the pipes, and providing an air-conditioning apparatus that is safe, reliable, and highly durable. Further, by allowing the heat medium to flow between passages through a pressure equalizing pipe, the differences in volume in each passage that are based on the temperature differences in the heat mediums can be suppressed. Furthermore, by having the pressure in the pipes between passages to be uniform, a single pressure absorber will be capable of absorbing the expansion pressure of plural passages, and accordingly, a space-saving apparatus can be designed.

DESCRIPTION OF EMBODIMENTS

Embodiment 1

Embodiment of the invention will be described below with reference to the drawings.

Figure 1:
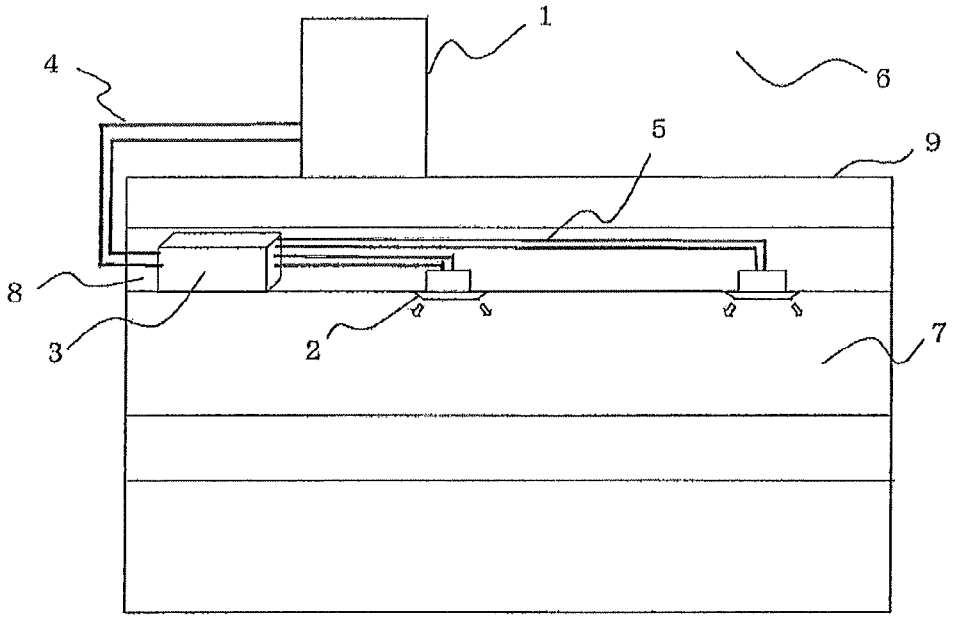
FIG. 1 is a diagram illustrating a system configuration an air-conditioning apparatus according to Embodiment 1 of the invention.
Figure 2:
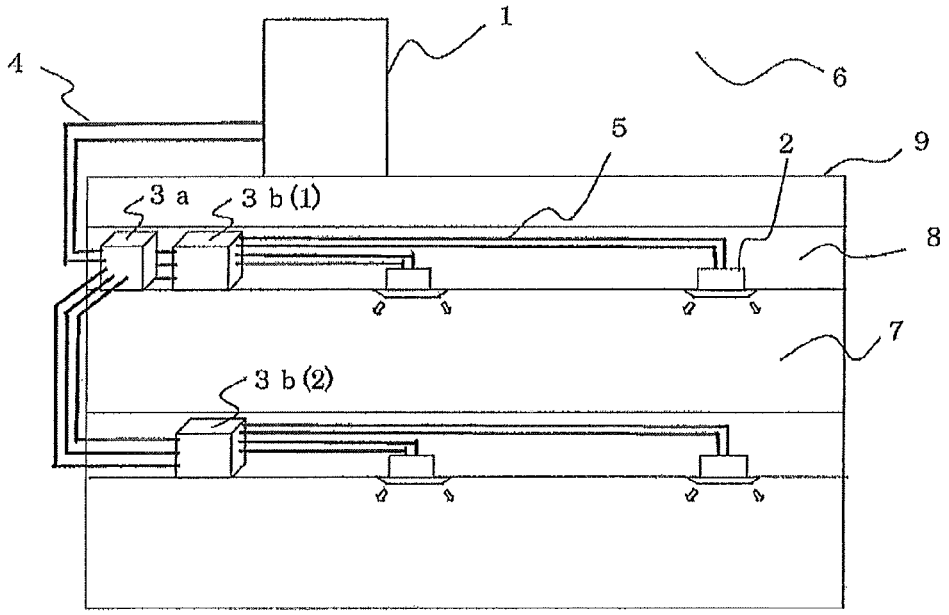
FIG. 2 is a diagram illustrating another system configuration of the air-conditioning apparatus according to Embodiment 1 of the invention.

FIGS. 1 and 2 are schematic diagrams illustrating installations of an air-conditioning apparatus according to Embodiment of the invention. The installations of the air-conditioning apparatus will be described with reference to FIGS. 1 and 2. This air-conditioning apparatus uses cycles (a refrigerant circuit A and a heat medium circuit B) through each of which a refrigerant (a heat source side refrigerant or a heat medium) is circulated such that a cooling mode or a heating mode can be arbitrarily selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 is configured to exchange heat between the heat source side refrigerant and the heat medium. The outdoor unit 1 is connected with the heat medium relay unit 3 via refrigerant pipes 4 through which the heat source side refrigerant is conveyed. The heat medium relay unit 3 is connected to each indoor unit 2 via pipes (heat medium pipes) 5 through which the heat medium is conveyed. Cooling energy or heating energy produced in the outdoor unit 1 is delivered through the heat medium relay unit 3 to the indoor units 2.

Referring to FIG. 2, the air-conditioning apparatus according to Embodiment includes a single outdoor unit 1, a plurality of indoor units 2, a plurality of separated heat medium relay units 3 (a main heat medium relay unit 3*a* and sub heat medium relay units 3*b*) arranged between the outdoor unit 1 and the indoor units 2. The outdoor unit 1 is connected to the main heat medium relay unit 3*a* through the refrigerant pipes 4. The main heat medium relay unit 3*a* is connected to the sub heat medium relay units 3*b* through the refrigerant pipes 4. Each of the sub heat medium relay units 3*b* is connected to each indoor unit 2 through the pipes 5. Cooling energy or heating energy produced in the outdoor unit 1 is delivered through the main heat medium relay unit 3*a* and the sub heat medium relay units 3*b* to the indoor units 2.

The outdoor unit 1, typically disposed in an outdoor space 6 that is a space (e.g., a roof) outside a structure 9, such as a building, is configured to supply cooling energy or heating energy through the heat medium relay unit 3 to the indoor units 2. Each indoor unit 2 is disposed at a position such that it can supply cooling air or heating air to an indoor space 7 which is a space (e.g., a living room) inside the structure 9 and is configured to supply the cooling air or heating air to the indoor space 7, that is, to a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipes 4 and is connected to the indoor units 2 through the pipes 5 to convey cooling energy or heating energy, supplied from the outdoor unit 1, to the indoor units 2.

As illustrated in FIGS. 1 and 2, in the air-conditioning apparatus according to Embodiment, the outdoor unit 1 is connected to the heat medium relay unit 3 using two refrigerant pipes 4, and the heat medium relay unit 3 is connected to each indoor unit 2 using two pipes 5. As described above, in the air-conditioning apparatus according to Embodiment, each of the units (the outdoor unit 1, the indoor units 2, and the heat medium relay unit 3) is connected using two pipes (the refrigerant pipes 4 or the pipes 5), thus facilitating construction.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2))

derived from the main heat medium relay unit 3*a*. This separation allows a plurality of sub heat medium relay units 3*b* to be connected to the single main heat medium relay unit 3*a*. In this configuration, the number of refrigerant pipes 4 connecting the main heat medium relay unit 3*a* to each sub heat medium relay unit 3*b* is three. Detail of the circuit will be described in detail later (refer to FIG. 3A).

Furthermore, FIGS. 1 and 2 illustrate a state where each heat medium relay unit 3 is disposed in a space different from the indoor space 7, for example, a space above a ceiling (hereinafter, simply referred to as a "space 8") inside the structure 9. The heat medium relay unit 3 can be placed in other spaces, e.g., a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 as long as the used outdoor unit 1 is of a water-cooled type. Even when the outdoor unit 1 is disposed in such a place, no problem in particular will occur.

Furthermore, the heat medium relay unit 3 can be disposed near the outdoor unit 1. If the distance between the heat medium relay unit 3 and each indoor unit 2 is too long, the conveyance power for the heat medium will be considerably large. It should be therefore noted that the energy saving effect is reduced in this case. In addition, the number of outdoor units 1, the number of indoor units 2, and the number of heat medium relay units 3 that are connected are not limited to the numbers illustrated in FIGS. 1 and 2. The numbers may be determined depending on the structure 9 where the air-conditioning apparatus according to Embodiment is installed.

Figure 3:
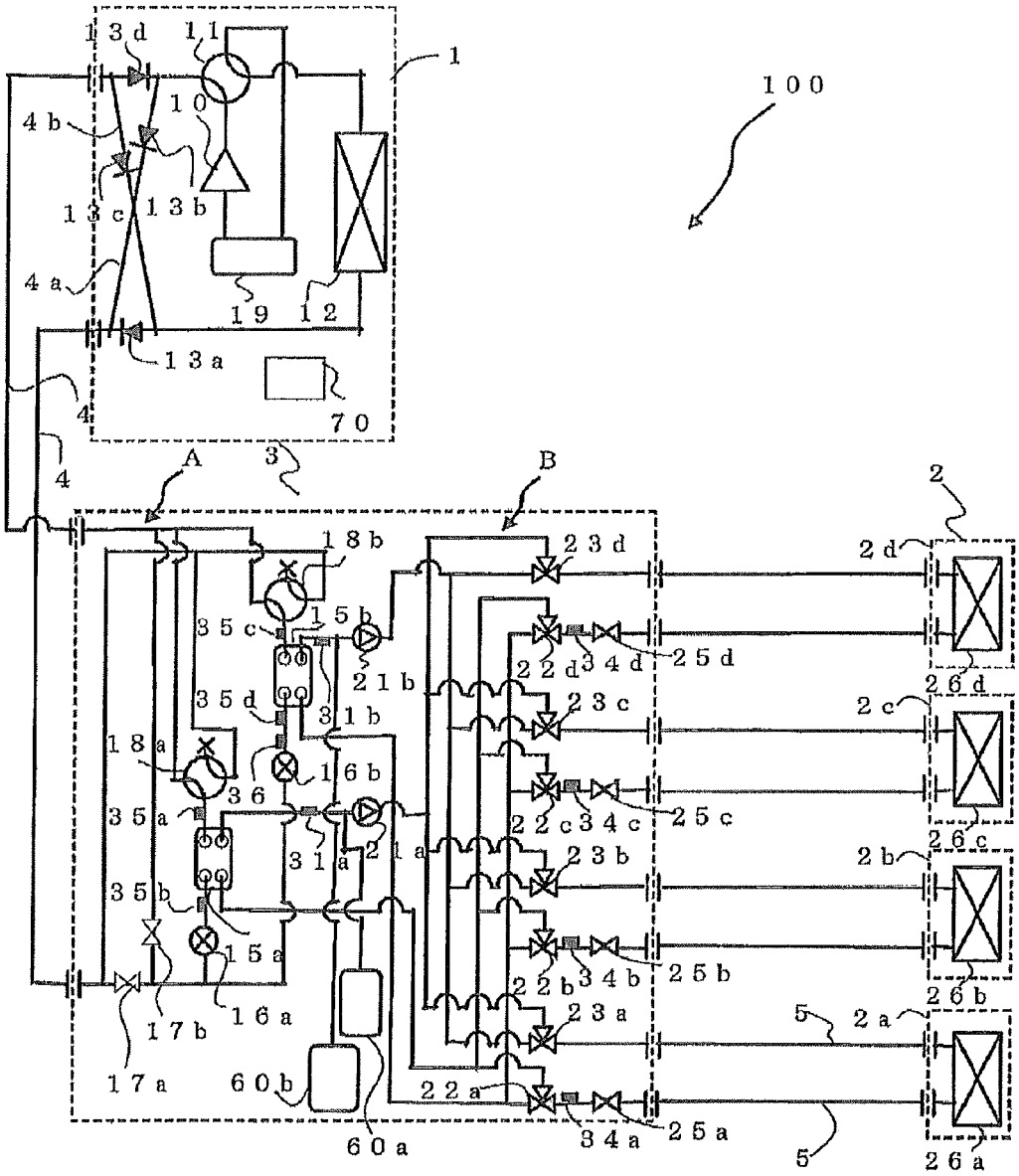
FIG. 3 is a system circuit diagram of the air-conditioning apparatus according to Embodiment 1 of the invention.

FIG. 3 is a schematic configuration diagram illustrating a circuit configuration of the air-conditioning apparatus (hereinafter, referred to as an "air-conditioning apparatus 100") according to Embodiment. The detailed configuration of the air-conditioning apparatus 100 will be described with reference to FIG. 3. Referring to FIG. 3, the outdoor unit 1 is connected to the heat medium relay unit 3 via the refrigerant pipes 4 through a heat exchanger related to heat medium 15*a* and a heat exchanger related to heat medium 15*b* which function as a heating/cooling unit are provided for the heat medium relay unit 3. Furthermore, the heat medium relay unit 3 is connected to the indoor units 2 via the pipes 5 through the heat exchanger related to heat medium 15*a* and the heat exchanger related to heat medium 15*b*.

[Outdoor Unit 1]

The outdoor unit 1 includes a compressor 10, a first refrigerant flow switching device 11, such as a four-way valve, a heat source side heat exchanger 12, and an accumulator 19 which are connected in series through the refrigerant pipe 4. The outdoor unit 1 further includes a first connecting pipe 4*a*, a second connecting pipe 4*b*, a check valve 13*a*, a check valve 13*b*, a check valve 13*c*, and a check valve 13*d*. Such arrangement of the first connecting pipe 4*a*, the second connecting pipe 4*b*, the check valve 13*a*, the check valve 13*b*, the check valve 13*c*, and the check valve 13*d* allows the heat source side refrigerant, allowed to flow into the heat medium relay unit 3, to flow in a constant direction irrespective of the operation requested by any indoor unit 2.

The compressor 10 is configured to suck the heat source side refrigerant and compress the heat source side refrigerant to a high-temperature, high-pressure state, and may be, for example, a capacity-controllable inverter compressor. The first refrigerant flow switching device 11 is configured to switch flows between that of the heat source side refrigerant during a heating operation (including a heating only operation mode and a heating main operation mode) and that of the heat source side refrigerant during a cooling operation (including a cooling only operation mode and a cooling main operation mode). The heat source side heat exchanger 12 is configured to function as an evaporator in the heating operation, function as a condenser (or a radiator) in the cooling operation, exchange heat between air supplied from the not shown air-sending device, such as a fan, and the heat source side refrigerant, and evaporate and gasify or condense and liquefy the heat source side refrigerant. The accumulator 19 is disposed on the suction side of the compressor 10 and is configured to store excess refrigerant.

The check valve 13*d* is provided for the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is provided for the refrigerant pipe 4 positioned between the heat source side heat exchanger 12 and the heat medium relay unit 3 and is configured to allow the heat source side refrigerant to flow only in a predetermined direction (the direction from the outdoor unit 1 to the heat medium relay unit 3). The check valve 13*b* is provided for the first connecting pipe 4*a* and is configured to allow the heat source side refrigerant discharged from the compressor 10, during the heating operation, to flow through the heat medium relay unit 3. The check valve 13*c* is disposed in the second connecting pipe 4*b* and is configured to allow the heat source side refrigerant, returned from the heat medium relay unit 3 during the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. It should be noted that FIG. 3 illustrates a case in which the first connecting pipe 4*a*, the second connecting pipe 4*b*, the check valve 13*a*, the check valve 13*b*, the check valve 13*c*, and the check valve 13*d* are arranged but the arrangement is not limited to this case. It is not always essential to provide these components.

[Indoor Unit 2]

The indoor units 2 each include a use side heat exchanger 26. Each of this use side heat exchangers 26 is connected to a heat medium flow control device 25 and a second heat medium flow switching device 23 in the heat medium relay unit 3 through the pipes 5. Each of this use side heat exchanger 26 is configured to exchange heat between air supplied from an air-sending device, such as a fan, (not illustrated) and the heat medium in order to produce heating air or cooling air to be supplied to the indoor space 7.

FIG. 3 illustrates a case in which four indoor units 2 are connected to the heat medium relay unit 3. Illustrated are, form the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that the number of indoor units 2 connected is not limited to four as illustrated in FIG. 3, in a manner similar to the cases in FIGS. 1 and 2.

[Heat Transfer Medium Relay Unit 3]

The heat medium relay unit 3 includes the two heat exchangers related to heat medium 15, two expansion devices 16, two opening and closing devices 17, two second refrigerant flow switching devices 18, two pumps 21, four first heat medium flow switching devices 22, the four second heat medium flow switching devices 23, the four heat medium flow control devices 25, and two expansion tanks 60. A configuration in which the heat medium relay unit 3 is separated into the main heat medium relay unit 3*a* and the sub heat medium relay unit 3*b* will be described later with reference to FIG. 3A.

Each of the two heat exchangers related to heat medium 15 (the heat exchanger related to heat medium 15*a* and the heat exchanger related to heat medium 15*b*) is configured to function as a condenser (radiator) or an evaporator and exchange heat between the heat source side refrigerant and the heat medium in order to transfer cooling energy or heating energy, produced by the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to cool the heat medium in the cooling and heating mixed operation mode. The heat exchanger related to heat medium 15*b* is disposed between an expansion device 16*b* and a second refrigerant flow switching device 18*b* in the refrigerant circuit A and is used to cool the heat medium in the cooling and heating mixed operation mode.

The two expansion devices 16 (the expansion device 16*a* and the expansion device 16*b*) each have functions of a reducing valve and an expansion valve and are configured to reduce the pressure and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, e.g., an electronic expansion valve.

The two opening and closing devices 17 (an opening and closing device 17*a* and an opening and closing device 17*b*) each include, for example, a two-way valve and are configured to open or close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side of the heat source side refrigerant and the refrigerant pipe 4 on an outlet side thereof. The two second refrigerant flow switching devices 18 (the second refrigerant flow switching device 18*a*, the second refrigerant flow switching device 18*b*) each include, for example, a four-way valve and are configured to switch flow directions of the heat source side refrigerant in accordance with the operation mode. The second refrigerant flow switching device 18*a* is arranged downstream of the heat exchanger related to heat medium 15*a*, downstream regarding the heat source side refrigerant flow during the cooling only operation and the cooling main operation. The second refrigerant flow switching device 18*b* is arranged downstream of the heat exchanger related to heat medium 15*b*, downstream regarding the heat source side refrigerant flow during the cooling only operation.

The two pumps 21 (a pump 21*a* and a pump 21*b*), serving as heat medium sending devices, are configured to circulate the heat medium flowing in the heat medium circuit B. The pump 21*a* is disposed between the heat exchanger related to heat medium 15*a* and the second heat medium flow switching devices 23, and drives to circulate the heat medium related to the heat exchange in the heat exchanger related to heat medium 15*a*. The pump 21*b* is disposed between the heat exchanger related to heat medium 15*b* and the second heat medium flow switching devices 23, and drives to circulate the heat medium related to the heat exchange in the heat exchanger related to heat medium 15*b*. In each first heat medium flow switching devices 22 and each second heat medium flow switching devices 23, unless all the passages of each switching devices are open (hereinafter, referred as "communicating"), circulating channels each with two independent passages are formed in which circulation is carried out. The two pumps 21 may each include pumps that can vary its discharge capacity according to control of a controller 70, for example. Expansion tanks 60*a* and 60*b* serve as pressure absorbers that absorb changes in the pressure of the heat medium in the pipes, which are caused by an increase and decrease in the volume of the heat medium. The expansion tanks 60 will be described later.

The four first heat medium flow switching devices 22 (first heat medium flow switching device 22*a* to first heat medium flow switching device 22*d*) in Embodiment each have three inlet/outlet ports (openings) and switch the flow direction of the heat medium by its opening, closing, or the like. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a* (pump 21*a*), another one of the three ways is connected to the heat exchanger related to heat medium 15*b* (pump 26*b*), and the other one of the three ways is connected to the heat medium flow control device 25. Accordingly, each first heat medium flow switching device 22 can communicate with either one of the heat exchanger related to heat medium 15*b* or heat exchanger related to heat medium 15*a* and can direct the heat medium flowing from the corresponding use side heat exchanger 26 (heat medium flow control device 25). Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four first heat medium flow switching devices 23 (second heat medium flow switching device 23*a* to second heat medium flow switching device 23*d*) in Embodiment each have three inlet/outlet ports (openings) and switch the flow direction of the heat medium by its opening, closing, or the like. The first heat medium flow switching devices 23 are arranged so that the number thereof (four in this case) corresponds to the installed number of indoor units 2. Each first heat medium flow switching device 23 is disposed on an inlet side of a heat medium passage of the corresponding use side heat exchanger 26 such that one of the three ways is connected to the corresponding heat exchanger related to heat medium 15*a*, another one of the three ways is connected to the corresponding heat exchanger related to heat medium 15*b*, and the other one of the three ways is connected to the corresponding use side heat exchanger 26. Accordingly, each first heat medium flow switching device 23 can communicate with either one of the heat exchanger related to heat medium 15*b* or heat exchanger related to heat medium 15*a* and can direct the heat medium to flow into the corresponding use side heat exchanger 26 (heat medium flow control device 25). Furthermore, illustrated from the bottom of the drawing are the first heat medium flow switching device 23*a*, the first heat medium flow switching device 23*b*, the first heat medium flow switching device 23*c*, and the first heat medium flow switching device 23*d*, so as to correspond to the respective indoor units 2.

The first heat medium flow switching device 22 and the second heat medium flow switching device 23 in Embodiment may not only switch passages but also may be capable of communicating among all passages. In accordance with the flow of the heat medium, the second heat medium flow switching device 23 merges the heat medium from two passages and makes the merged heat medium flow into the use side heat exchanger 26. The first heat medium flow switching device 22 branches the heat medium flowing out of the use side heat exchanger 26 into two passages.

At this time, for example, depending on the structure of the first heat medium flow switching device 22 and the second heat medium flow switching device 23, each opening, in which the heat medium flows into/from the pumps 21*a* and 21*b*, is set to an intermediate degree. As for the intermediate opening degree, it is basically preferable that the opening area of the portion in which the heat medium flows into/from the pumps 21*a* and 21*b* are substantially the same. However, this is not a limitation, and may be any degree as long as the opening degree allows the heat medium to flow through each passage.

The four heat medium flow control devices 25 (heat medium flow control devices 25*a* to 25*d*) each include, for example, a two-way valve capable of controlling the area of an opening and changing the opening degree of the pipe 5 that is a flow passage of the heat medium, and are configured to control the flow rate of the heat medium. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. Alternatively, the heat medium flow control device 25 may be disposed in the passage of the heat medium on the inlet side of each use side heat exchanger 23.

The heat medium relay unit 3 further includes various detecting devices (two first temperature sensors 31, four second temperature sensors 34, four third temperature sensors 35, and a pressure sensor 36). Information (temperature information and pressure information) detected by these detecting devices are transmitted to the controller 70 that performs integrated control of the operation of the air-conditioning apparatus 100 such that the information is used to control, for example, the driving frequency of the compressor 10, the rotation speed of the air-sending device (not illustrated), switching by the first refrigerant flow switching device 11, the driving frequency of the pumps 21, switching by the second refrigerant flow switching devices 18, and switching of passages of the heat medium.

Each of the two first temperature sensors 31 (a first temperature sensor 31*a* and a first temperature sensor 31*b*) is configured to detect the temperature of the heat medium flowing out of the heat exchanger related to heat medium 15, namely, the heat medium at an outlet of the heat exchanger related to heat medium 15 and may include, for example, a thermistor. The first temperature sensor 31*a* is disposed in the pipe 5 connected to an inlet of the pump 21*a*. The first temperature sensor 31*b* is disposed in the pipe 5 connected to an inlet of the pump 21*b*.

Each of the four second temperature sensors 34 (second temperature sensors 34*a* to 34*d*) is disposed between the first heat medium flow switching device 22 and the heat medium flow control device 25 and is configured to detect the temperature of the heat medium flowing out of the use side heat exchanger 26 and may include, for example, a thermistor. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat medium 15 and is configured to detect the temperature of the heat source side refrigerant flowing into the heat exchanger related to heat medium 15, or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching devices 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching devices 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Furthermore, the controller 70 includes, for example, a microcomputer and controls, for example, the driving frequency of the compressor 10, the rotation speed (including ON/OFF) of the air-sending device, switching by the first refrigerant flow switching device 11, driving of the pumps 21, the opening degree of each expansion device 16, opening and closing of each opening and closing device 17, switching by the second refrigerant flow switching devices 18, switching by the first heat medium flow switching devices 22, switching by the second heat medium flow direction switching devices 23, and the drive of each heat medium flow control device 25 on the basis of the information detected by the various detecting devices and an instruction from a remote control to carry out the operation modes which will be described later. The controller 70 also includes timers and other timing devices that can measure time. Although the controller 70 is disposed in the outdoor unit 1, this does not limit the place where the controller 70 is disposed. For example, control devices in which processing functions executed by the controller 70 are shared can be disposed in the indoor units 2 and heat medium relay unit 3 and processing can be carried out while signals are being sent and received over communication lines or the like. Alternatively, the controller 70 can be disposed outside the air-conditioning apparatus.

The pipes 5 for conveying the heat medium include the pipes connected to the heat exchanger related to heat medium 15*a* and the pipes connected to the heat exchanger related to heat medium 15*b*. Each pipe 5 is branched (into four in this case) in accordance with the number of indoor units 2 connected to the heat medium relay unit 3. The pipes 5 are connected through the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 and whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat medium 15*a*, the expansion devices 16, and the accumulator 19 are connected through the refrigerant pipes 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipes 5, thus forming heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Figure 3A:
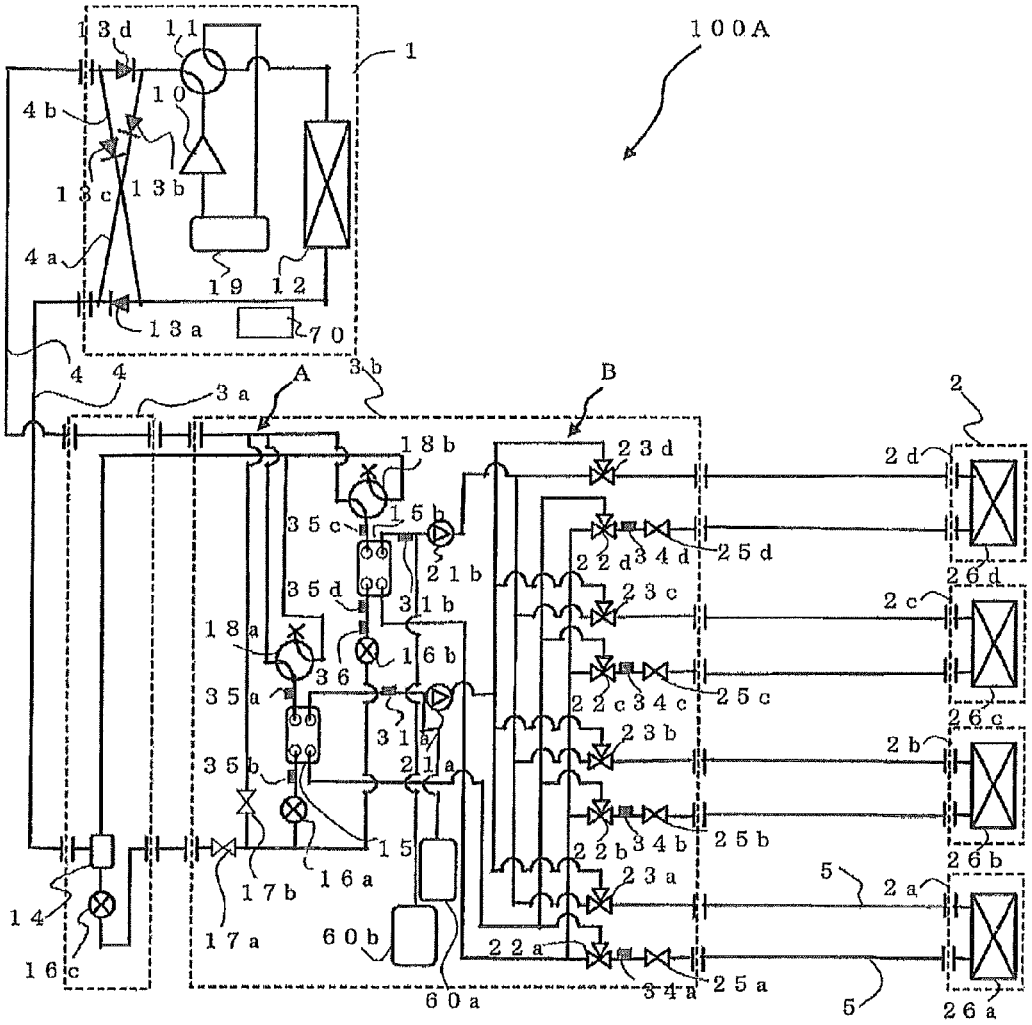
FIG. 3A is another system circuit diagram of the air-conditioning apparatus according to Embodiment 1 of the invention.

FIG. 3A is a schematic configuration diagram illustrating another configuration of an air-conditioning apparatus (hereinafter, referred to as an "air-conditioning apparatus 100A") according to Embodiment. The configuration of the air-conditioning apparatus 100A in a case in which a heat medium relay unit 3 is separated into a main heat medium relay unit 3*a* and a sub heat medium relay unit 3*b* will be described with reference to FIG. 3A. Referring to FIG. 3A, a housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant pipe 4 connected to an outdoor unit 1 and is connected to two refrigerant pipes 4 connected to a heat exchanger related to heat medium 15*a* and a heat exchanger related to heat medium 15*b* in the sub heat medium relay unit 3*b*, and is configured to separate heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and is configured to reduce the pressure and expand the heat source side refrigerant. During a cooling and heating mixed operation, the expansion device 16*c* is controlled such that the pressure state of the refrigerant in an outlet side of the expansion device 16*c* is controlled to become a medium state. The expansion device 16*c* may include a component having a variably controllable opening degree, e.g., an electronic expansion valve. This arrangement allows a plurality of sub heat medium relay units 3*b* to be connected to the main heat medium relay unit 3*a*.

Operation modes carried out by the air-conditioning apparatus 100 will be described. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation. Other operation modes carried out by the air-conditioning apparatus 100 are the cooling main operation mode in which the cooling load is larger, and the heating main operation mode in which the heating load is larger (the cooling main operation mode and heating main operation mode may be collectively called the cooling and heating mixed operation mode). Each operation mode will be described below with respect to the flow of the heat source side refrigerant and that of the heat medium.

[Cooling Only Operation Mode]

Figure 4:
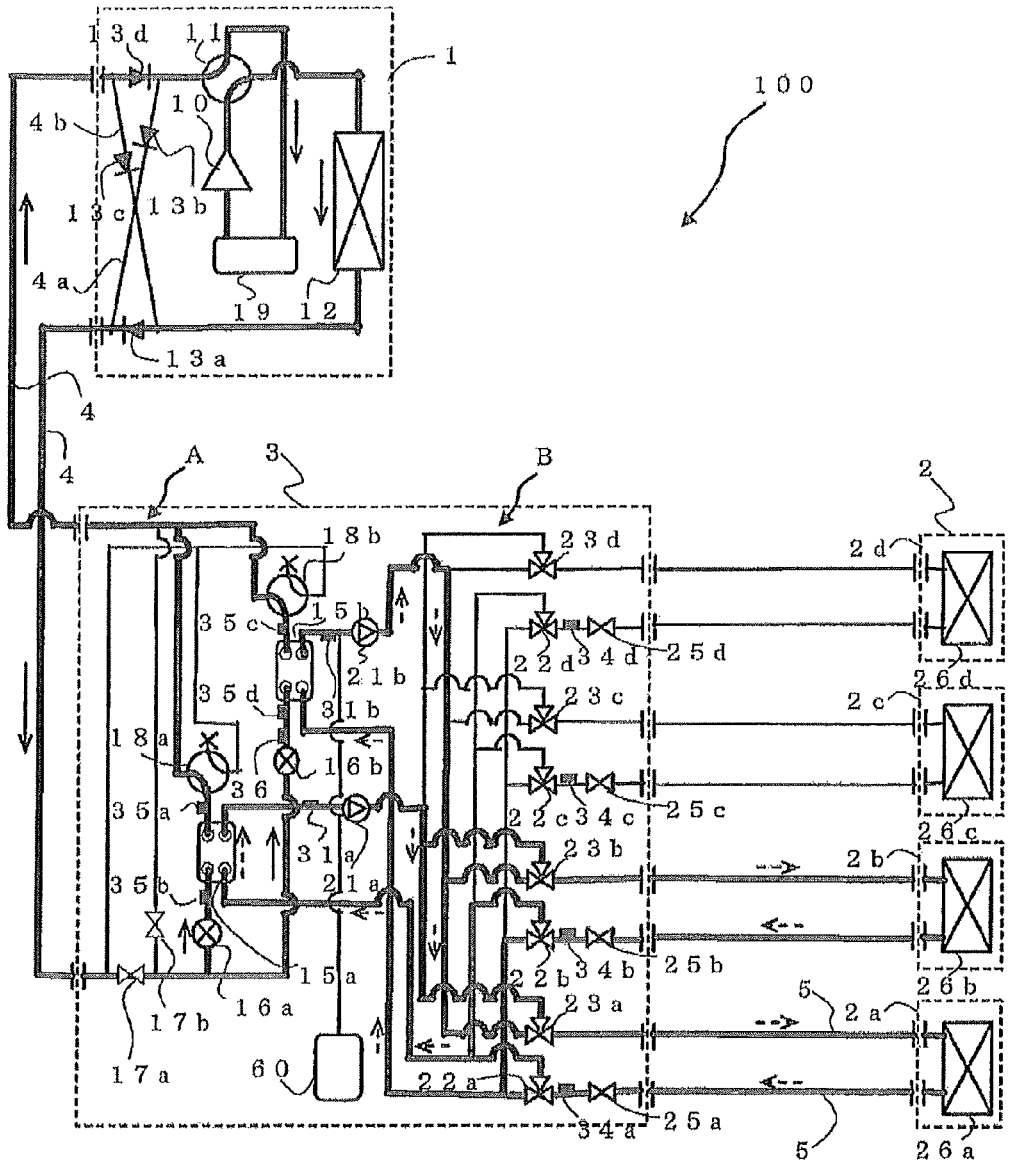
FIG. 4 is a system circuit diagram of the air-conditioning apparatus according to Embodiment 1 in a cooling only operation mode.

FIG. 4 is a refrigerant circuit diagram illustrating the flows of refrigerants in the cooling only operation mode of the air-conditioning apparatus 100. The cooling only operation mode will be described with respect to a case in which a cooling load is generated only in a use side heat exchanger 26*a* and a use side heat exchanger 26*b* in FIG. 4. Furthermore, in FIG. 4, pipes indicated by thick lines correspond to pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 4. Note that in FIGS. 4 to 7, only one expansion tank 60 is provided in the description.

In the cooling only operation mode illustrated in FIG. 4, in the outdoor unit 1, a first refrigerant flow switching device 11 is switched such that the heat source side refrigerant discharged from a compressor 10 flows into a heat source side heat exchanger 12. In the heat medium relay unit 3, a pump 21*a* and a pump 21*b* are driven, a heat medium flow control device 25*a* and a heat medium flow control device 25*b* are opened, and a heat medium flow control device 25*c* and a heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in a refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed into a high-pressure liquid refrigerant while transferring heat to outdoor air in the heat source side heat exchanger 12. The high-pressure liquid refrigerant flowing out of the heat source side heat exchanger 12 passes through a check valve 13*a*, flows out of the outdoor unit 1, passes through the refrigerant pipe 4, and flows into the heat medium relay unit 3. The high-pressure liquid refrigerant flowing into the heat medium relay unit 3 is branched after passing through an opening and closing device 17*a* and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b*, functioning as evaporators, removes heat from the heat medium circulating in a heat medium circuit B to cool the heat medium, and thus turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding one of a second refrigerant flow switching device 18*a* and a second refrigerant flow switching device 18*b*, passes through the refrigerant pipe 4, and again flows into the outdoor unit 1. The refrigerant flowing into the outdoor unit 1 passes through a check valve 13*d*, the first refrigerant flow switching device 11, and an accumulator 19, and is then again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by a third temperature sensor 35*c* and that detected by a third temperature sensor 35*d*. In addition, the opening and closing device 17*a* is opened and the opening and closing device 17*b* is closed.

Next, the flow of the heat medium in the heat medium circuit B will be described.

In the cooling only operation mode, both of the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cooling the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is then again sucked into the pump 21*a* and the pump 21*b*.

Note that in the pipe 5 in each use side heat exchanger 26, the heat medium is directed to flow from the second heat medium flow switching device 23 through the heat medium flow control device 25 to the first heat medium flow switching device 22. Furthermore, the difference between a temperature detected by the first temperature sensor 31*a* or that detected by the first temperature sensor 31*b* and a temperature detected by the second temperature sensor 34 is controlled such that the difference is kept at a target value, so that the air conditioning load required in the indoor space 7 can be covered. As regards a temperature at the outlet of each heat exchanger related to heat medium 15, either of the temperature detected by the first temperature sensor 31*a* and that detected by the first temperature sensor 31*b* may be used. Alternatively, the mean temperature of the two may be used. At this time, the opening degree of each of the first heat medium flow switching devices 22 and the second heat medium flow switching devices 23 is set to a medium degree such that the heat medium is communicated and that passages to both of the heat exchanger related to heat medium 15*a* and the heat exchanger related to heat medium 15*b* are established. Both the heat exchanger related to heat medium 15*a* and the heat exchanger related to heat medium 15*b* are used for cooling the heat medium such that heat transfer area is increased, enabling efficient cooling operation.

Figure 5:
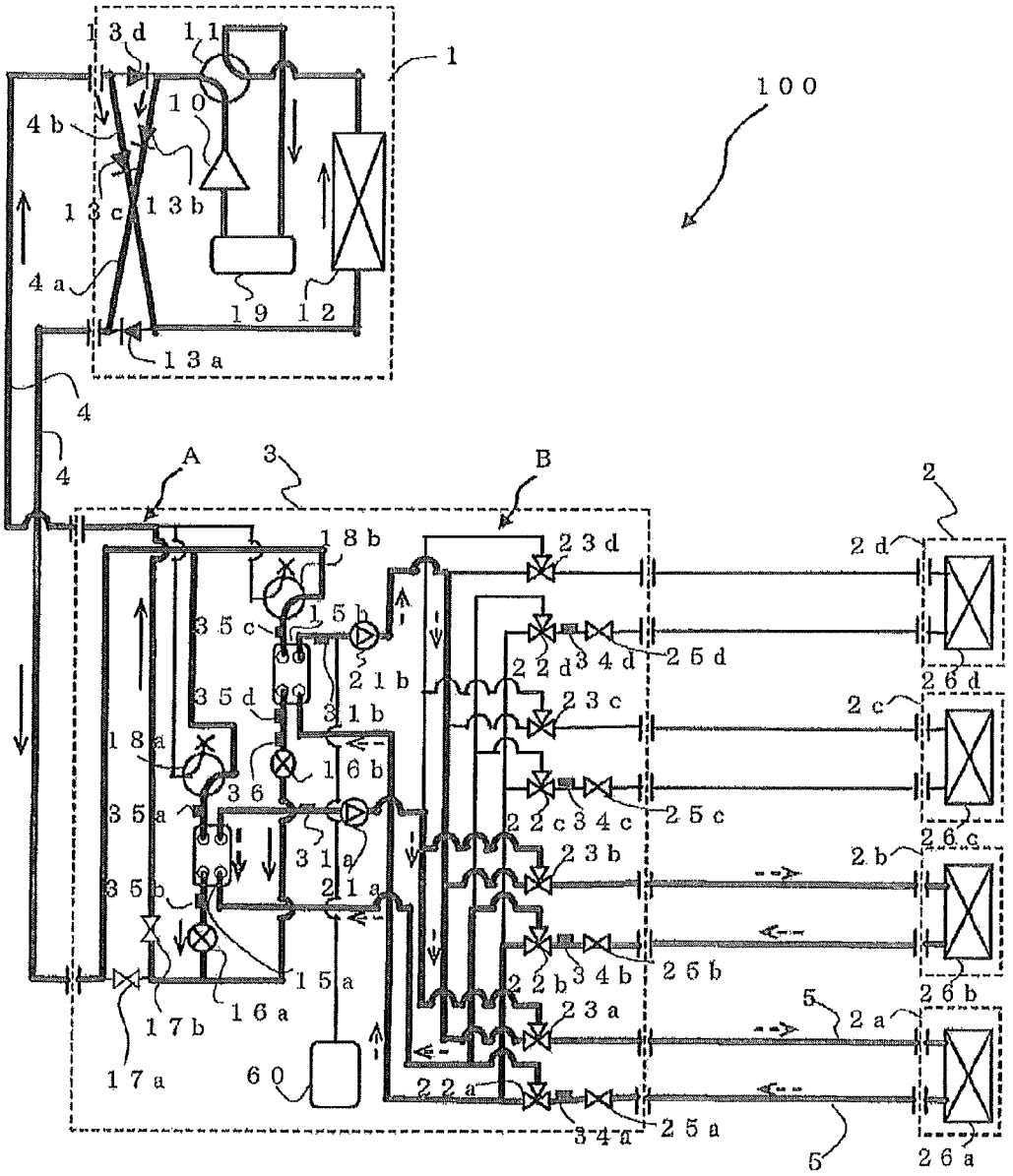
FIG. 5 is a system circuit diagram of the air-conditioning apparatus according to Embodiment 1 in a heating only operation mode.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. In FIG. 5, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

FIG. 5 is a refrigerant circuit diagram illustrating the flows of the refrigerants in the heating only operation mode of the air-conditioning apparatus 100. The heating only operation mode will be described with respect to a case in which a heating load is generated only in the use side heat exchanger 26*a* and the use side heat exchanger 26*b* in FIG. 5. Furthermore, in FIG. 5, pipes indicated by thick lines correspond to pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 5.

In the heating only operation mode illustrated in FIG. 5, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant flowing into the heat medium relay unit 3 is branched. The refrigerant passes through each of the second refrigerant flow switching device 18*a* and the second refrigerant flow switching device 18*b* and flows into the corresponding one of the heat exchanger related to heat medium 15*a* and the heat exchanger related to heat medium 15*b*.

The high-temperature high-pressure gas refrigerant flowing into each of the heat exchanger related to heat medium 15*a* and the heat exchanger related to heat medium 15*b* is condensed into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant through the expansion device 16*a* and the expansion device 16*b*. This two-phase refrigerant passes through the opening and closing device 17*b*, flows out of the heat medium relay unit 3, passes through the refrigerant pipe 4, and again flows into the outdoor unit 1. The refrigerant flowing into the outdoor unit 1 flows through the second connecting pipe 4*b*, passes through the check valve 13*c*, and flows into the heat source side heat exchanger 12, functioning as an evaporator.

Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*a* is controlled such that subcooling (the degree of subcooling) is constant, the subcooling being obtained as the difference between a value indicating a saturation temperature calculated from a pressure detected by the pressure sensor 36 and a temperature detected by the third temperature sensor 35*b*. Similarly, the opening degree of the expansion device 16*b* is controlled such that subcooling is constant, the subcooling being obtained as the difference between the value indicating the saturation temperature calculated from the pressure detected by the pressure sensor 36 and a temperature detected by the third temperature sensor 35*d*. In addition, the opening and closing device 17*a* is closed and the opening and closing device 17*b* is opened. Note that in the case in which a temperature can be measured at the middle position of the heat exchangers related to heat medium 15, the temperature at the middle position may be used instead of the pressure sensor 36. Thus, such a system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipes 5. The heat medium, which has flowed out of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium transfers heat to the indoor air through each of the use side heat exchanger 26*a* and the use side heat exchanger 26*b*, thus heating the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a the flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is then again sucked into the pump 21*a* and the pump 21*b*.

Note that in the pipe 5 in each use side heat exchanger 26, the heat medium is directed to flow from the second heat medium flow switching device 23 through the heat medium flow control device 25 to the first heat medium flow switching device 22. Furthermore, the difference between a temperature detected by the first temperature sensor 31*a* or that detected by the first temperature sensor 31*b* and a temperature detected by the second temperature sensor 34 is controlled such that the difference is kept as a target value, so that the air conditioning load required in the indoor space 7 can be covered. As regards a temperature at the outlet of each heat exchanger related to heat medium 15, either of the temperature detected by the first temperature sensor 31*a* and that detected by the first temperature sensor 31*b* may be used. Alternatively, the mean temperature of the two may be used.

At this time, the opening degree of each of the first heat medium flow switching devices 22 and the second heat medium flow switching devices 23 is set to, for example, a medium degree such that the heat medium is communicated and that passages to both of the heat exchanger related to heat medium 15*a* and the heat exchanger related to heat medium 15*b* are established. Both the heat exchanger related to heat medium 15*a* and the heat exchanger related to heat medium 15*b* are used for heating the heat medium such that heat transfer area is increased, enabling efficient cooling operation.

Although the use side heat exchanger 26*a* should essentially be controlled on the basis of the difference between a temperature at the inlet and that at the outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. In FIG. 5, the heat medium is supplied to the use side heat exchanger 26*a* and the use side heat exchanger 26*b* because these use side heat exchangers each have a heat load. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 6:
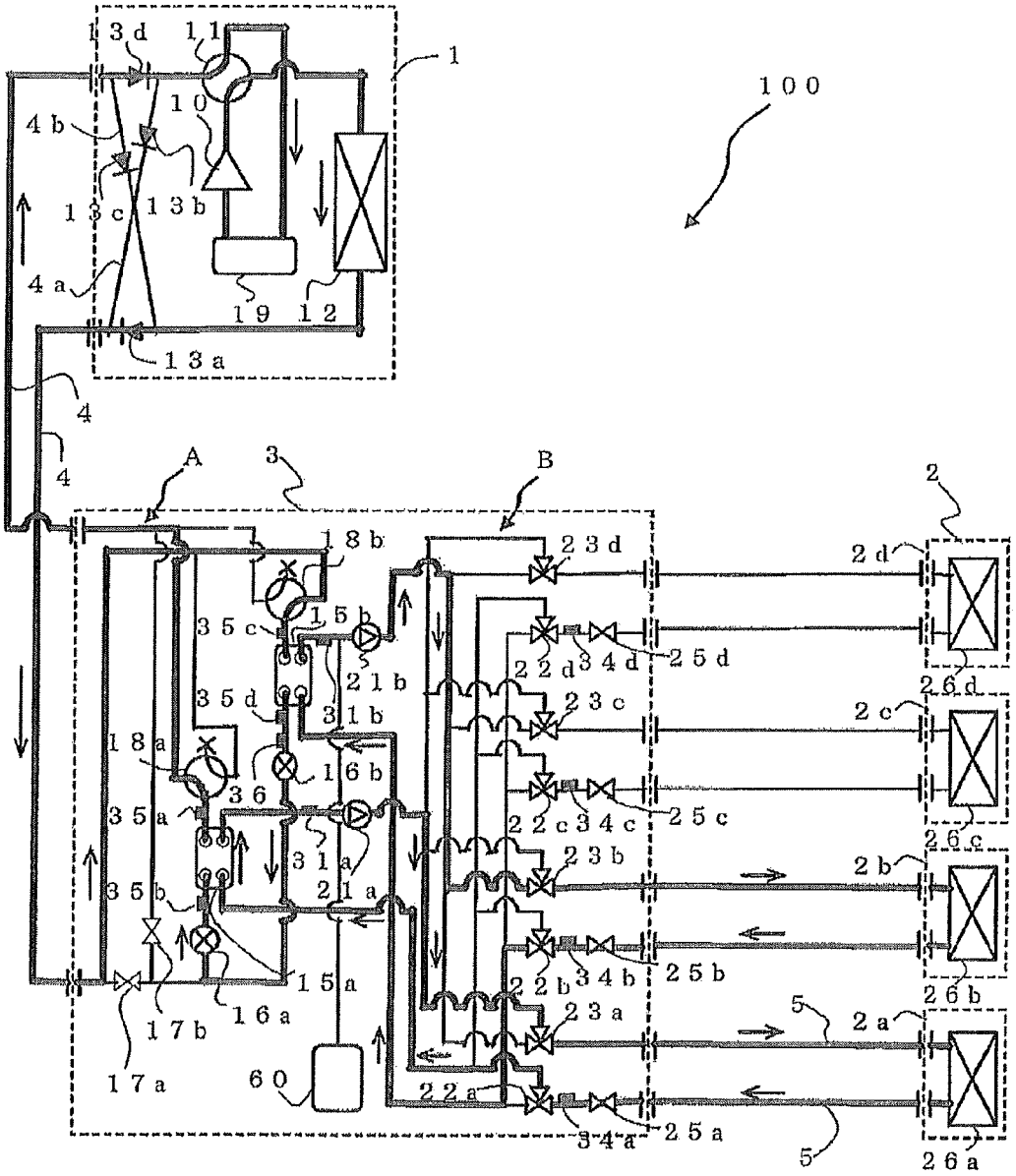
FIG. 6 is a system circuit diagram of the air-conditioning apparatus according to Embodiment 1 in a cooling main operation mode.

FIG. 6 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 6. Furthermore, in FIG. 6, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 6.

In the cooling main operation mode illustrated in FIG. 6, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchanger 26*a* and the heat medium circulates between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant pipe 4, and flows into the heat medium relay unit 3. The two-phase refrigerant flowing into the heat medium relay unit 3 passes through the second refrigerant flow switching device 18*b*(2) and flows into the heat exchanger related to heat medium 15*b*, functioning as a condenser.

The two-phase refrigerant flowing into the heat exchanger related to heat medium 15*b* is condensed into a liquid refrigerant while transferring heat to the heat medium circulating in the heat medium circuit B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B to cool the heat medium, and thus turns into a low-pressure gas refrigerant. This gas refrigerant flows out of the heat exchanger related to heat medium 15*a*, flows through the second refrigerant flow switching device 18*a* out of the heat medium relay unit 3, passes through the refrigerant pipe 4, and again flows into the outdoor unit 1. The refrigerant flowing into the outdoor unit 1 passes through the check valve 13*d*, the first refrigerant flow switching device 11, and the accumulator 19, and is then again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the opening and closing device 17*a* is closed, and the opening and closing device 17*b* is closed. In addition, the opening degree of the expansion device 16*b* may be controlled such that subcooling is constant, the subcooling being obtained as the difference between a value indicating a saturation temperature calculated from a pressure detected by the pressure sensor 36 and a temperature detected by the third temperature sensor 35*d*. Alternatively, the expansion device 16*b* may be fully opened and the expansion device 16*a* may control superheat or subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipes 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium transfers heat to the indoor air, thus heating the indoor space 7. In addition, in the use side heat exchanger 26*a*, the heat medium removes heat from the indoor air, thus cooling the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is then again sucked into the pump 21*b*. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then again sucked into the pump 21*a*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipe 5 in each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. In FIG. 6, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 7:
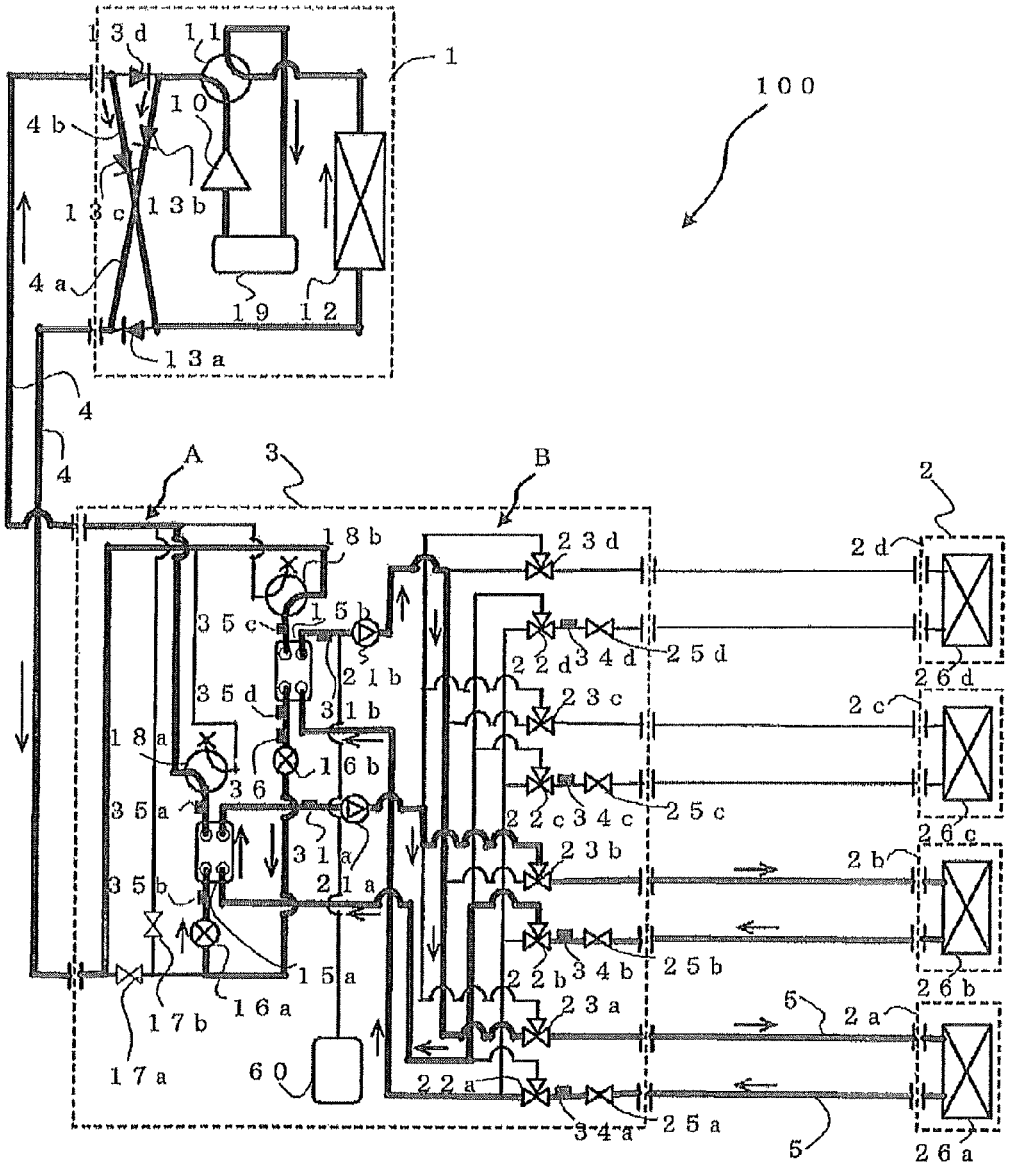
FIG. 7 is a system circuit diagram of the air-conditioning apparatus according to Embodiment 1 in a heating main operation mode.

FIG. 7 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 7. Furthermore, in FIG. 7, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7.

In the heating main operation mode illustrated in FIG. 7, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between the heat exchanger related to heat medium 15*a* and the use side heat exchanger 26*b* and the heat medium circulates between the heat exchanger related to heat medium 15*b* and the use side heat exchanger 26*a*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant flowing into the heat medium relay unit 3 passes through the second refrigerant flow switching device 18*b* and flows into the heat exchanger related to heat medium 15*b*, functioning as a condenser.

The gas refrigerant flowing into the heat exchanger related to heat medium 15*b* is condensed into a liquid refrigerant while transferring heat to the heat medium circulating in the heat medium circuit B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B to evaporate, thus cooling the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant pipe 4, and again flows into the outdoor unit 1.

The refrigerant flowing into the outdoor unit 1 passes through the check valve 13*c* and flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a value indicating a saturation temperature calculated from a pressure detected by the pressure sensor 36 and a temperature detected by the third temperature sensor 35*b*. In addition, the expansion device 16*a* is fully opened, the opening and closing device 17*a* is closed, and the opening and closing device 17*b* is closed. Alternatively, the expansion device 16*b* may be fully opened and the expansion device 16*a* may control subcooling.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipes 5. Furthermore, in the heating main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heating the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is then again sucked into the pump 21*a*. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is then again sucked into the pump 21*b*.

During this time, the first heat medium flow switching devices 22 and the second heat medium flow direction switching devices 23 allow the heated heat medium and the cooled heat medium to be introduced into the respective use side heat exchangers 26 having a heating load and a cooling load, without being mixed. Note that in the pipe 5 in each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* such that the difference is kept as a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. In FIG. 7, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Pipe 4]

As described above, the air-conditioning apparatus 100 according to Embodiment has the several operation modes. In these operation modes, the heat source side refrigerant flows through the refrigerant pipes 4 connecting the outdoor unit 1 and the heat medium relay unit 3.

[Pipe 5]

In some operation modes carried out by the air-conditioning apparatus 100 according to Embodiment, the heat medium, such as water or antifreeze, flows through the pipes 5 connecting the heat medium relay unit 3 and the indoor units 2. If there is no need in particular to distinguish the pipes, the passage of the heat medium except for those of the heat medium relay unit 3 and the indoor units will be included in and described as pipes 5, subsequently.

[Pressure Absorber 60]

Next, the expansion tanks (pressure absorbers) 60 shown in FIG. 3 will be described. Heat medium such as water increases its volume as temperature rises, and decreases its volume as temperature drops. When the passage is closed as in the heat medium circuit B, pressure change in the pipes caused by the expansion of the heat medium, which is a result of its volumetric change (expansion force), may cause the pipes 5 and the like to be damaged. Accordingly, the expansion tank 60 is connected to one of the pipes 5 to absorb the expansion force of the heat medium in the pipes 5, and thus suppresses the pressure change caused by the volumetric change of the heat medium in the heat medium circuit B.

Figure 8:
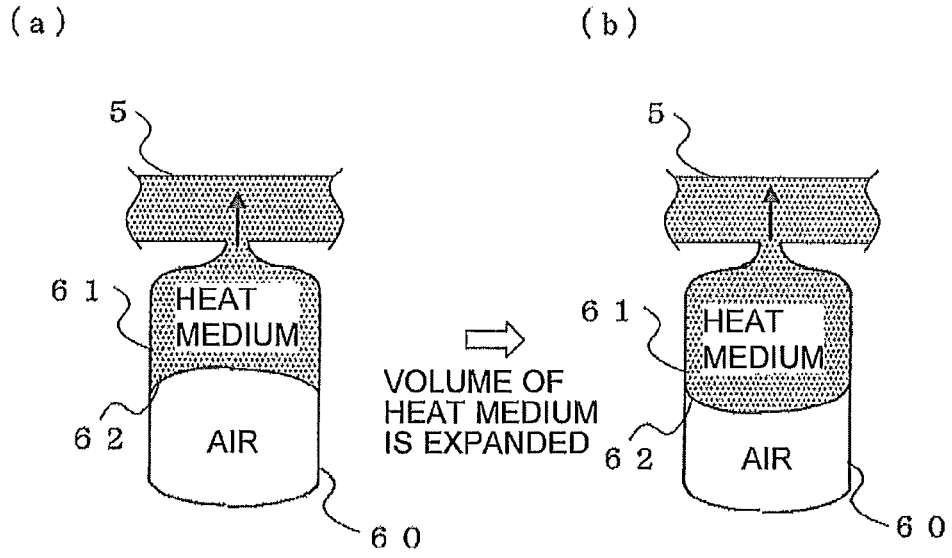
FIG. 8 is a diagram illustrating the structure of an expansion tank 60 of the air-conditioning apparatus according to Embodiment 1

FIG. 8 is a diagram illustrating the structure of the expansion tank 60. The expansion tank includes a flexible partition wall 62 made of rubber or the like in a vessel 61. Bounded by the partition wall 62, space on the upper side of the vessel 61 communicates with one of the pipes 5, and accumulates the heat medium (water) therein. Space on the lower side is a dead air space. The tank is structured such that when the temperature of the heat medium rises increasing the volume thereof, the partition wall 62 is pushed downward and expands by the volume of the volumetric increase, and thus absorbs the volumetric increase within the vessel 61. When the temperature of the heat medium drops, the volume thereof decreases, and thus the partition wall 62 is displaced upward. The expansion tank 60 shown in FIG. 8 is generally called a closed expansion tank and is convenient in use, but the expansion tank 60 is not limited to this structure. For example, the expansion tank 60 may be one that has the expansion space above the pipe 5 such as an open expansion tank.

In the heat medium circuit B of Embodiment, for example, a plurality of (two) passages are formed in the circuit; one being a passage of the circulating heat medium flowing into and out of the heat exchanger related to heat medium 15*a* (pump 21*a*), and the other being a passage of the circulating heat medium flowing into and out of the heat exchanger related to heat medium 15*b* (pump 21*b*). Passages described below, including the two passages, each basically designate a passage of a pump 21, heat exchanger related to heat medium 15, first heat medium flow switching device 22, and second heat medium flow switching device 23. As described above, during the cooling and heating mixed operation mode such as the cooling main operation mode or the heating main operation mode, no portion in the two passages communicate with each other. Hence, as shown in FIG. 3, each passage may be provided with an expansion tank 60 connected thereto.

In contrast, a system can be configured inexpensively and installation space can be reduced, if one expansion tank 60 is merely required to be installed to either one of the passages. In order to achieve this, a portion that can deal with the expansion forces of each of the passages is required.

Figure 9:
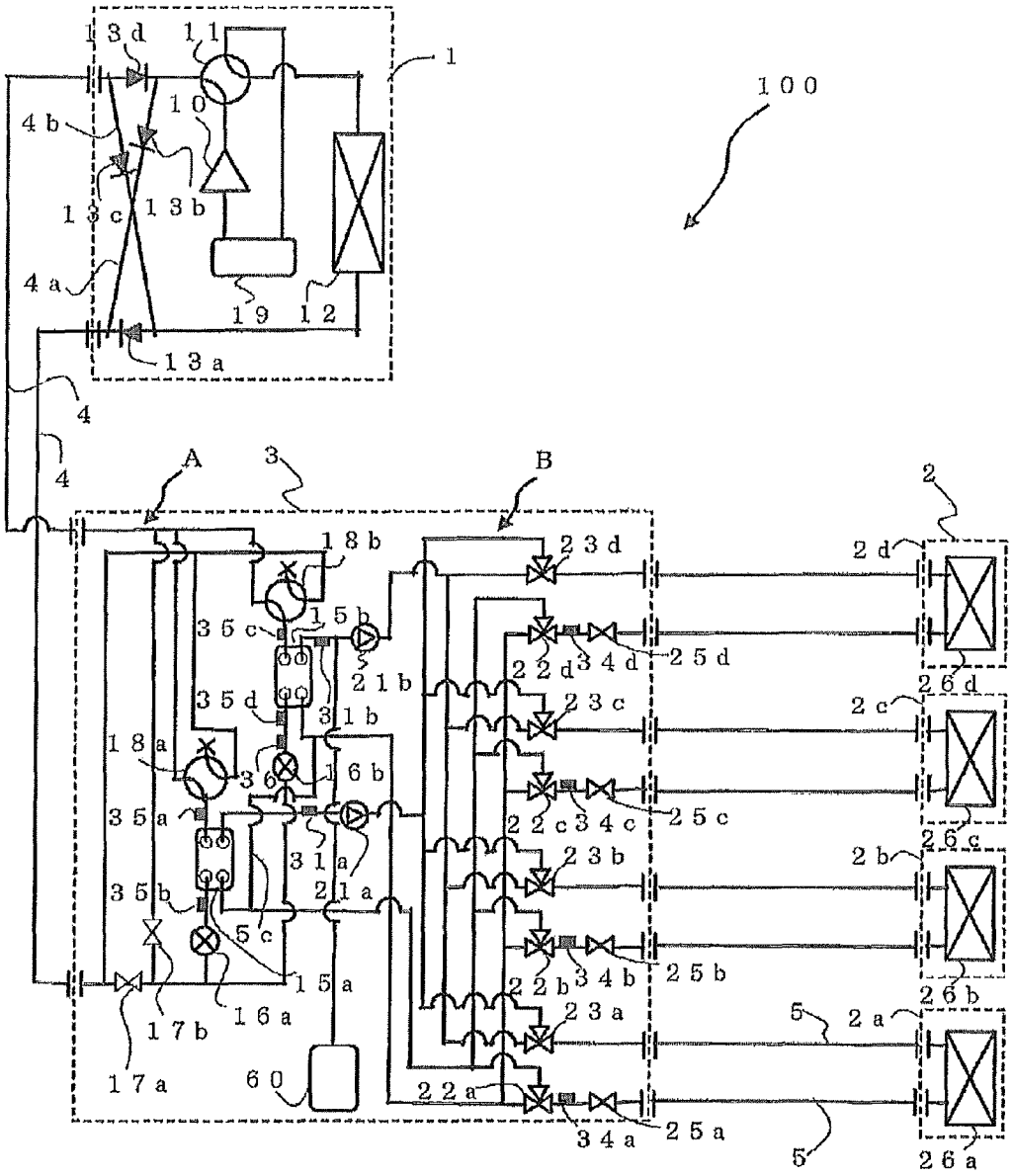
FIG. 9 is another system circuit diagram of the air-conditioning apparatus according to Embodiment 1.

FIG. 9 is a diagram showing the air-conditioning apparatus 100 that has been connected with a pressure equalizing pipe 5*c*. In FIG. 9, the expansion tank 60 is connected to either one of the two passages and the two passages are interconnected with the pressure equalizing pipe 5*c*. By providing the pressure equalizing pipe 5*c*, even during the cooling and heating mixed operation mode, the expansion force in each passage can be dealt with through the pressure equalizing pipe 5*c* and variations in volume in each passage caused by the temperature difference in the heat medium can be removed, and equalization of the pressure (pressure equalizing) in the pipes 5 within the two passages are achieved. Accordingly, a single expansion tank 60 provided in either one of the passages will enable absorption of the volumetric change of the heat medium in the entire heat medium circuit B, prevention of pipe damage or the like during operation, and improvement of safety and reliability. During the cooling only operation mode or heating only operation mode, not only the pressure equalizing pipe 5*c* but also the first heat medium flow switching devices 22 and the second heat medium flow switching devices 23 can enable the two passages to communicate with each other, it is effective in equalizing pressure at the start up or the like.

The pressure equalizing pipe 5*c* is connected between the passages on the inlet side of the pumps 21 or the passages on the outlet side of the pumps 21, to where it is assumed that the pressure condition of the heat medium in each passage is the same. The passage on the inlet side of each of the pumps 21 refers to a passage from the inlet (suction side) of the pumps 21 to corresponding first heat medium flow switching device 22, and the passage on the outlet side of each of the pumps 21 refers to a passage from the outlet (discharge side) of the pumps 21 to corresponding second heat medium flow switching device 23.

Further, if a thick pipe with a large diameter is used as the pressure equalizing pipe 5*c*, a flow of the heat medium is formed between the passages through the pressure equalizing pipe 5*c* during a normal operation. Accordingly, in the cooling and heating mixed operation mode or the like in which the difference in temperature between the passages are large, the heat medium in each passage is mixed (the heat medium usually flows from the high temperature side to the low temperature side), and efficiency is lowered by heat loss. Hence, a thin pipe with a diameter as small as possible is basically used as the pressure equalizing pipe 5*c* to increase the flow resistance of the heat medium in the pressure equalizing pipe 5*c* so that the heat medium does not easily flow into the pressure equalizing pipe 5*c*. The flow resistance of the heat medium in the pressure equalizing pipe 5*c* is set such that it is larger than the flow resistance in the pipe 5 that interconnects the heat medium relay unit 3 and each use side heat exchanger 26. In contrast, if the pressure equalizing pipe 5*c* is too thin, movement of the heat medium between the passages will be hindered, preventing the pressure from being equalized or taking much time. An appropriate pipe diameter and the like are necessary.

Next, the design and the like of the pressure equalizing pipe 5*c* will be described. For example, the pressure head h [m] and pressure H [Pa] of a heat medium in a pipe can be obtained by the Bernoulli's principle expressed as equations (1) below, which are generally known in fluid dynamics. In equations (1), U represents the flow velocity of the heat medium [m/s], g represents acceleration of gravity (=9.8) [m/s$^2$], ρ represents the density of the heat medium [kg/m$^3$], and P represents pressure [Pa].

[Math. 1]

$$h = \frac{U^2}{2 \cdot g} + \frac{P}{\rho \cdot g} \text{ [m]} \tag{1}$$

$$H = \frac{\rho \cdot U^2}{2} + P \text{ [Pa]}$$

In Embodiment, the heat medium circuit B includes two passages. The pressure head h [m] and pressure H [Pa] in each passage are expressed as equations (2) and (3) below. A passage in which a flow is formed by the driving of the pump 21*a* is referred to as a passage 1, and a passage in which a flow is formed by the driving of the pump 21*b* is referred to as a passage 2; these passages are represented by using subscripts 1 and 2.

[Math. 2]

$$h_1 = \frac{U_1^2}{2 \cdot g} + \frac{P_1}{\rho_1 \cdot g} \text{ [m]} \tag{2}$$

$$H_1 = \frac{\rho \cdot U_1^2}{2} + P_1 \text{ [Pa]}$$

$$h_2 = \frac{U_2^2}{2 \cdot g} + \frac{P_2}{\rho_2 \cdot g} \text{ [m]} \tag{3}$$

$$H_2 = \frac{\rho \cdot U_2^2}{2} + P_2 \text{ [Pa]}$$

Now, a case in which the rotation speed of the pump 21*b* is ½ of the rotation speed of the pump 21*a* will be considered. The rotation speed of the pump 21 is assumed to be proportional to the flow velocity of the heat medium in the passage. The flow velocity of the heat medium in the passage 2 is about ½ of the flow velocity of the heat medium in the passage 1. When the flow velocity in the passage 1 is 2 [m/s], for example, the flow velocity in the passage 2 is 1 [m/s].

If the rotation speed of each pump 21 is assumed to be proportional to a pressure difference ΔP between before (suction side) and after (discharging side) the pump 21, then a pressure difference $\Delta P_2$ in the passage 2 is about ½ of a pressure difference $\Delta P_1$ in the passage 1. If $\Delta P_1$ is 70 [kPa] (7.14 [m]), for example, then $\Delta P_2$ is 35 [kPa] (3.57 [m]).

If the densities $\rho_1$ and $\rho_2$ of the heat medium are assumed to be 1000 [kg/m$^3$] and the average pressure between before and after the pump is assumed to be 80 [kPa], then equations (4) and (5) shown below hold true for the suction sides of the pumps 21*a* and 21*b*. Accordingly, if the pressure equalizing pipe 5*c* is provided between the passage 1 and the passage 2, a pressure difference of about 3.42 [m] (33500 [Pa]), which is the difference in pressure between the two passages, is generated between both ends of the pressure equalizing pipe 5*c* as in equations (6).

[Math. 3]

$$\begin{aligned} h_1 &= \frac{U_1^2}{2 \cdot g} + \frac{P_0 - \Delta P_1}{\rho_1 \cdot g} \\ &= \frac{2^2}{2 \times 9.8} + \frac{(80-70) \times 10^3}{1000 \times 9.8} \\ &= 1.22 \text{ [m]} \end{aligned} \tag{4}$$

$$\begin{aligned} H_1 &= \frac{\rho_1 \cdot U_1^2}{2} + (P_0 - \Delta P_1) \\ &= \frac{1000 \times 2^2}{2} + (80-70) \times 10^3 \\ &= 12000 \text{ [Pa]} \end{aligned}$$

$$\begin{aligned} h_2 &= \frac{(U_1/2)^2}{2 \cdot g} + \frac{P_0 - \Delta P_1/2}{\rho_2 \cdot g} \\ &= \frac{1^2}{2 \times 9.8} + \frac{(80-35) \times 10^3}{1000 \times 9.8} \\ &= 4.64 \text{ [m]} \end{aligned} \tag{5}$$

$$\begin{aligned} H_2 &= \frac{\rho_2 \times (U_1/2)^2}{2} + (P_0 - \Delta P_1/2) \\ &= \frac{1000 \times 1^2}{2} + (80-35) \times 10^3 \\ &= 45500 \text{ [Pa]} \end{aligned}$$

$$h_2 - h_1 = 4.64 - 1.22 = 3.42 \text{ [m]}$$

$$H_2 - H_1 = 45500 - 12000 = 33500 \text{ [Pa]}$$

A pressure loss h [m] caused by friction generated in the flow of the heat medium in the pipe can be obtained from the Darcy-Weisbach equations, expressed as equations (7) below, which are generally known in fluid dynamics.

[Math. 4]

$$h = f \cdot (L/d) \cdot [U^2/(2 \cdot g)]$$

$$H = f \cdot (L/d) \cdot [\rho \cdot U^2/2] \tag{7}$$

In equations (7), f represents the friction coefficient of the pipe, U represents the flow velocity [m/s] of the heat medium, g represents acceleration of gravity (=9.8) [m/s$^2$], d represents a pipe diameter (inner diameter) [m], and L represents a pipe length [m]. The friction coefficient f can be obtained from, for example, the Blasius equation expressed as equation (8) below, which is generally known in fluid dynamics. In equation (8), Re represents the Reynolds number and ν represents the kinematic viscosity [m$^2$/s] of the heat medium.

[Math. 5]

$$f = \frac{0.3164}{Re^{1/4}} = \frac{0.3164}{\left(\frac{U \cdot d}{\nu}\right)^{1/4}} \tag{8}$$

If the passage 1 and passage 2 are interconnected by the pressure equalizing pipe 5*c*, the difference in pressure between both ends of the pressure equalizing pipe 5*c* and the pressure loss due to the internal friction of the pressure equalizing pipe 5*c* should be the same. Accordingly, the flow rate in the pressure equalizing pipe 5*c* can be obtained from equations (7) and (8).

If, for example, the inner diameter d of the pressure equalizing pipe 5*c* is set to 5 [mm], its length L to 0.6 [m], and the kinematic viscosity of the heat medium to $1.5 \times 10^{-6}$ [m$^2$/s], and if the flow velocity U of the heat medium is 4.4 [m/s], the pressure loss h is 3.42 [m] (33500 [Pa]), as indicated by equations (9) and (10). The flow rate of the heat medium flowing in the pipe is obtained by multiplying the flow velocity 4.4 [m] of the heat medium by the cross sectional area of the pipe, yielding about 5.2 [L/min].

[Math. 6]

$$\begin{aligned} f &= \frac{0.3164}{Re^{1/4}} \\ &= \frac{0.3164}{\left[\frac{4.4 \times (5/1000)}{1.5 \times 10^{-6}}\right]^{1/4}} \\ &= 2.87 \times 10^{-2} \end{aligned} \tag{9}$$

$$\begin{aligned} h &= f \cdot (L/d) \cdot [U^2/(2 \cdot g)] \\ &= (2.87 \times 10^{-2}) \cdot [0.6/(5 \times 10^{-3})] \cdot [4.4^2/(2 \times 9.8)] \\ &= 3.42 \text{ [m]} \end{aligned} \tag{10}$$

$$\begin{aligned} H &= f \cdot (L/d) \cdot [\rho \cdot U^2/2] \\ &= (2.87 \times 10^{-2}) \cdot [0.6/(5 \times 10^{-3})] \cdot [1000 \times 4.4^2/2] \\ &= 33500 \text{ [Pa]} \end{aligned}$$

In practice, the pipe diameters of the passage 1 and passage 2 differ from the pipe diameter of the pressure equalizing pipe 5*c*. If the pressure equalizing pipe 5*c* includes a curved portion or the like, it creates flow resistance and thereby the flow rate of the heat medium flowing in the pressure equalizing pipe 5*c* will be lower than the flow rate calculated above. Since other resistances are also caused by the branching and merging of the heat medium flowing in the passages, the actual flow rate of the heat medium flowing in the pressure equalizing pipe 5*c* is considerably lower than the flow rate calculated above.

In Embodiment, the passage 1 and passage 2, in particular, are interconnected by the pressure equalizing pipe 5*c* alone. Thus, during a cooling and heating mixed operation, for example, the flowing of the heat medium from the passage 2 into the passage 1 increases the pressure in the passage 1 and reduces the pressure in the heat medium passage 2. As a result, the pressure of each passages is balanced. Therefore, as the pressure difference becomes smaller with time, the flow rate of the heat medium flowing from the passage 2 to the passage 1 becomes gradually small.

When the pipe 5, which interconnects the heat medium relay unit 3 and each indoor unit 2, is designed such that the flow rate of the heat medium is about 15 L/min, for example, compared to the flow rate of the pipe 5, heat medium with the flow rate of ⅓ or lower according to calculation, or ⅕ to 1/10 in practice, will momentarily flow in the pressure equalizing pipe 5*c*, and will gradually decrease its flow rate.

If during the design phase, the flow resistance is set and each values (in particular, the inner diameter) is determined such that the flow rate of the heat medium is allowed to flow in the pressure equalizing pipe 5*c* to the above extent, the heat loss can be reduced and damage of the pipes can be prevented by the appropriate equalization of pressure.

Since, in the air-conditioning apparatus 100 according to Embodiment 1, the expansion tank 60 is provided in the heat medium circuit B with the expansion tank 60 to absorb the temperature-induced expansion force of the heat medium as describe above, it is possible to obtain a safe, highly-reliable, and highly durable air-conditioning apparatus that can suppresses changes in pressure in the pipe 5 and prevent damage and the like of the pipe 5. Furthermore, since the pressure equalizing pipe 5*c* enables two passages to communicate with each other in, for example, the cooling and heating mixed operation mode, it becomes possible to suppress variations in volume induced by the difference in the temperature of the heat medium between the two passages and to equalize the pressure in the pipes 5 of the two passages. Therefore, even if, for example, only a single expansion tank 60 is provided in the heat medium circuit B, the expansion force of the heat medium can be transferred from a passage to which the expansion tank 60 is not connected to a passage to which the expansion tank 60 is connected. Since there is no need to provide a plurality of expansion tanks 60, space saving, cost reduction, and the like can be achieved. Since the passages on the inlet sides or the outlet sides of each of the pumps 21 are connected to each other under the same pressure condition, it becomes possible to equalize the pressure related to the change in volume, which is caused by a difference in temperature.

Heat loss caused by mixture of heat mediums of different temperature can be reduced, since the flow resistance of the pressure equalizing pipe 5*c* is made larger than the flow resistance of the pipe 5, which becomes a passage, making the heat medium hard to flow, permitting the heat medium to flow in the pressure equalizing pipe 5*c* only when the pressure difference and the temperature difference between the two passages are at a large state.

Furthermore, in the heating only operation mode and cooling only operation mode, since each first heat medium flow switching device 22 and each second heat medium flow switching device 23 direct the heat medium in and out, between the two passages, pressure can be equalized by each first heat medium flow switching device 22 and each second heat medium flow switching device 23 as well.

Since the refrigerant circuit A is configured with the heat exchanger related to heat medium 15 to heat or cool the heat medium, efficient air conditioning using a refrigerant can be carried out. Since the heat medium relay unit 3 is provided as a unit separated from the outdoor unit 1 and indoor unit 2 and each unit is disposed so that pipes through which the heat medium circulates are shortened to the extent possible, conveyance power is smaller than when the heat medium is directly circulated between the outdoor unit and the indoor unit. Thus, energy can be saved.

Embodiment 2

In Embodiment 1 described above, through the pressure equalizing pipe 5*c*, variations in volume in each passage caused by the temperature difference in the heat medium is removed and pressure equalization is achieved. However, the pressure equalizing pipe 5*c* is thinner than the pipes 5 and it takes time until the pressures are equalized between the passages. Opportunities to equalize the pressures as fast as possible should be increased to achieve increase of safety.

Therefore, a first heat medium flow switching device 22 and a second heat medium flow switching device 23 in Embodiment are configured to be switchable such that two passages communicate with each other allowing a heat medium to flow therein, and achieve efficient equalization of pressure between the passages.

For example, when operation of one of a plurality of indoor units 2 is stopped by a remote controller and no cooling or heating is carried out, the first heat medium flow switching device 22 and the second heat medium flow switching device 23 corresponding to the indoor unit 2 can be arbitrarily switched. Thereupon, for example, a controller 70 switches the first heat medium flow switching device 22 and the second heat medium flow switching device 23 corresponding to the indoor unit 2 such that each passage is communicating so that the expansion forces of the heat medium can be dealt with in the first heat medium flow switching device 22 and the second heat medium flow switching device 23 as well.

In a case as well in which, for example, air temperature in a conditioned space has reached a target temperature and one of the indoor units 2 enters a thermo-off state in which the operation of the indoor unit 2 is temporarily suspended, the first heat medium flow switching device 22 and the second heat medium flow switching device 23 corresponding to the indoor unit 2 can be arbitrarily switched.

In the thermo-off state, however, there is a possibility of the indoor unit 2 returning to the previous operation state (heating or cooling). Therefore, the heat medium with a temperature difference should not be immediately mixed so as to prevent energy from being wasted. Moreover, since the temperature of the heat medium does not change immediately after the indoor unit enters the thermo-off state, the controller 70 leaves the first heat medium flow switching device 22 and second heat medium flow switching device 23 as they are for a certain time (10 minutes, for example) after entering the thermo-off state to prevent the heat medium from being mixed. If the controller 70 determines that the indoor unit is still in the thermo-off state even after the elapse of the certain time, the controller 70 switches the first heat medium flow switching device 22 and second heat medium flow switching device 23 so that the passages communicate with each other and the expansion forces of the heat medium in the passages are dealt with.

When a pump 21*a* or pump 21*b* is operating, the indoor unit 2 that is in a suspended state (including the thermo-off state) has a smaller thermal resistance than the indoor unit 2 that is carrying out cooling or heating. As described in Embodiment 1, therefore, if all openings are open with, for example, an intermediate opening degree, so that all passages communicate with each other, a heat medium flow that passes through the suspended indoor unit 2 may be formed. Therefore, the opening degree (opening area) of a heat medium flow control device 25 corresponding to the suspended indoor unit 2 is adequately reduced to prevent the heat medium from flowing into the suspended indoor unit 2 (use side heat exchanger 26).

As described above, since the air-conditioning apparatus 100 according to Embodiment 2 makes two passages communicate with each other through the first heat medium flow switching device 22 and second heat medium flow switching device 23 when the operation of the indoor unit 2 is suspended, the expansion force of the heat medium can be dealt with through the first heat medium flow switching device 22 and second heat medium flow switching device 23 as well as the pressure equalizing pipe 5*c*, so the pressure can be efficiently equalized.

Further, when the indoor unit 2 enters the thermo-off state, in which its operation is temporarily suspended, and if it remains to be in the thermo-off state even after the elapse of a certain time, the two passages are made to communicate with each other, so the pressures can be efficiently equalized. Particularly, in the thermo-off state, cooling or heating may be resumed immediately, so waiting for a certain time to elapse will enable prevention of cooling (or heating) using the mixed and heated (or cooled) heat medium, and will enable suppression of heat loss.

When all passages are made to communicate with an intermediate opening degree, the heat medium flow control device 25 is controlled so that the heat medium does not flow into the suspended indoor unit 2 (use side heat exchanger 26), so heat is not conveyed to the suspended indoor unit 2 and the heat loss can thereby be suppressed.

Embodiment 3

Although not described in the above embodiments, the first heat medium flow switching device 22 and second heat medium flow switching device 23 described in the above embodiments, for example, may be components such as a stepper-motor-driven mixing valve capable of changing flow rates of passages, instead of a switching device that opens and closes its opening. Alternatively, two valves such as electronic expansion valves, each of which can change the flow rates in two-way passages, may be combined. These first heat medium flow switching device 22 and second heat medium flow switching device 23 can control the merging and branching of the heat mediums. In this case, water hammer caused when a passage is suddenly opened or closed can be prevented.

Although the above Embodiment has been described with respect to the case in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the heat medium flow control device 25, a stepper-motor-driven type that is capable of controlling a flow rate in a passage may be used. Alternatively, a two-way valve or a three-way valve whose one end is closed may be used. Alternatively, as regards each of the heat medium flow control device 25, a component, such as an on-off valve, which is capable of opening or closing a two-way passage, may be used while ON and OFF operations are repeated to control an average flow rate.

Furthermore, while each second refrigerant flow switching device 18 is illustrated as a four-way valve, the device is not limited to this valve. A plurality of two-way flow switching valves or three-way flow switching valves may be used such that the refrigerant flows in the same manner.

While the air-conditioning apparatus 100 according to Embodiment has been described with respect to the case in which the apparatus can perform the cooling and heating mixed operation, the apparatus is not limited to the case. For example, even in an apparatus that is configured by a single heat exchanger related to heat medium 15 and a single expansion device 16 that are connected to a plurality of parallel use side heat exchangers 26 and heat medium flow control devices 25, and is capable of carrying out only a cooling operation or a heating operation, the same advantages can obtained.

In addition, it is needless to say that the same holds true for the case in which a single use side heat exchanger 26 and a single heat medium flow control device 25 are connected. Moreover, obviously, no problem will arise even if the heat exchanger related to heat medium 15 and the expansion device 16 acting in the same manner are arranged in plural numbers. Furthermore, while the case in which the heat medium flow control devices 25 are arranged in the heat medium relay unit 3 has been described, the arrangement is not limited to this case. Each heat medium flow control device 25 may be disposed in the indoor unit 2. The heat medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat medium 15*a* or the heat exchanger related to heat medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is high in its safety, contribution to improvement of safety can be made.

Typically, a heat source side heat exchanger 12 and a use side heat exchanger 26*a* to 26*d* are provided with an air-sending device and a current of air often facilitates condensation or evaporation. The structure is not limited to this case. For example, a heat exchanger, such as a panel heater, using radiation can be used as the use side heat exchanger 26*a* to 26*d* and a water-cooled heat exchanger that transfers heat using water or antifreeze can be used as the heat source side heat exchanger 12. In other words, as long as the heat exchanger is configured to be capable of transferring heat or removing heat, any type of heat exchanger can be used.

While Embodiment has been described with respect to the case in which the number of use side heat exchangers 26*a* to 26*d* is four, the number of the use side heat exchangers is not especially limited.

In addition, while Embodiment has been described with respect to the case in which two heat exchangers related to heat medium are arranged, namely, heat exchanger related to heat medium 15*a* and the heat exchanger related to heat medium 15*b*, it goes without saying that the arrangement is not limited to this case. As long as the heat exchanger related to heat medium 15 is configured to be capable of cooling or/and heating the heat medium, the number of heat exchangers related to heat medium 15 arranged is not limited.

Furthermore, as regards each of the pump 21*a* and the pump 21*b*, the number of pumps is not limited to one. A plurality of pumps having a small capacity may be connected in parallel.

REFERENCE SIGNS LIST

1 outdoor unit, 1B outdoor unit, 2 indoor unit, 2*a* indoor unit, 2*b* indoor unit, 2*c* indoor unit, 2*d* indoor unit, 3 heat medium relay unit, 3B heat medium relay unit, 3*a* main heat medium relay unit, 3*b* sub heat medium relay unit, 4 refrigerant pipe, 4*a* first connection pipe, 4*b* second connection pipe, 5 pipe, 5*c* pressure equalizing pipe (refrigerant pipe), 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 14 gas-liquid separator, 15 heat exchanger related to heat medium, 15*a* heat exchanger related to heat medium, 15*b* heat exchanger related to heat medium, 16 expansion device, 16*a* expansion device, 16*b* expansion device, 16*c* expansion device, 17 opening and closing device, 17*a* opening and closing device, 17*b* opening and closing device, 17*c* opening and closing device, 17*d* opening and closing device, 17*e* opening and closing device, 17*f* opening and closing device, 18 second refrigerant flow switching device, 18*a* second refrigerant flow switching device, 18*b* second refrigerant flow switching device, 19 accumulator, 21 pump, 21*a* pump, 21*b* pump, 22 first heat medium flow switching device, 22*a* first heat medium flow switching device, 22*b* first heat medium flow switching device, 22*c* first heat medium flow switching device, 22*d* first heat medium flow switching device, 23 second heat medium flow switching device, 23*a* second heat medium flow switching device, 23*b* second heat medium flow switching device, 23*c* second heat medium flow switching device, 23*d* second heat medium flow switching device, 25 heat medium flow control device, 25*a* heat medium flow control device, 25*b* heat medium flow control device, 25*c* heat medium flow control device, 25*d* heat medium flow control device, 26 use side heat exchanger, 26*a* use side heat exchanger, 26*b* use side heat exchanger, 26*c* use side heat exchanger, 26*d* use side heat exchanger, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 41 flow switching part, 42 flow switching part, 60 expansion tank, 61 vessel, 62 partition wall, 70 controller, 100 air-conditioning apparatus, 100A air-conditioning apparatus, 100B air-conditioning apparatus, A refrigerant circuit, B heat medium circuit.

The invention claimed is:

1. An air-conditioning apparatus, comprising:

indoor units including a plurality of use side heat exchangers that exchange heat between air with which heat is to be exchanged and a heat medium;

a heat medium relay unit including a plurality of heating/cooling units that heat or cool the heat medium, a plurality of heat medium pumps that deliver the heat medium involved in heating or cooling performed by the heating/cooling units to circulation passages corresponding to the heating/cooling units respectively and circulate the heat medium in each of the circulation passages, and a plurality of heat medium flow switching devices that each perform switching so that at least one heat medium in the plurality of passages corresponding to the heating/cooling units flow into and flow out of the corresponding use side heat exchanger;

a pressure absorber that connects to one of the passages, the pressure absorber alleviating a pressure change caused by a volumetric change of the heat medium; and a pressure equalizer consisting of a pipe branched between an inlet passage of one pump corresponding to one circulation passage and an inlet passage of another pump corresponding to another circulation passage or branched between an outlet passage of the one pump corresponding to one circulation passage and an outlet passage of the another pump corresponding to the another circulation passage, the pressure equalizer pipe configured to eliminate a pressure difference caused by a temperature difference of the heat medium in the circulation passages, wherein the pressure equalizer pipe is sized so that a flow rate of the heat medium in the pressure equalizer pipe is less than or equal to ⅓ of the flow rate of the heat medium in the circulation passages.

2. The air-conditioning apparatus of claim 1, the heating/cooling units being heat exchangers related to heat medium which exchange heat between a refrigerant and the heat medium, the air-conditioning apparatus further comprising an outdoor unit constituting a refrigerant circuit by connecting a compressor that pressurizes the refrigerant, a refrigerant flow switching device that switches a circulating channel of the refrigerant, a heat source side heat exchanger for the refrigerant to exchange heat, and an expansion device that adjusts pressure of the refrigerant with the heat exchangers related to heat medium thereto by piping.

3. The air-conditioning apparatus of claim 1, further comprising a controller to control switching of the heat medium flow switching device corresponding to the use side heat exchanger in an indoor unit, operation of which has been suspended, so that each circulation passage corresponding to each of the heating/cooling units communicates with each other.

4. The air-conditioning apparatus of claim 3, further comprising a plurality of flow rate control devices that each adjust a flow rate of the heat medium that is made to flow into and flow out of the corresponding use side heat exchanger, wherein the controller controls the flow rate control device corresponding to the use side heat exchanger in the suspended indoor unit such that the heat medium does not flow into the indoor unit.

5. The air-conditioning apparatus of claim 1, further comprising a controller to control switching of the heat medium flow switching device corresponding to the use side heat exchanger in an indoor unit, operation of which is temporarily suspended based on a target temperature of air with which heat is to be exchanged, so that each passage corresponding to each of the heating/cooling units communicates with each other when the controller determines that a suspended state has continued even after a predetermined time from the beginning of the suspension.

6. The air-conditioning apparatus of claim 1, wherein the indoor units, the heat medium relay unit, and the outdoor unit are structured so as to be separately housed and placed at separate locations to each other.

7. The air-conditioning apparatus of claim 1, wherein the pressure equalizer pipe is dimensioned so that a flow resistance of the heat medium in the pressure equalizer pipe is larger than a flow resistance in any set of two pipes that interconnect the heat medium relay unit and each of the indoor units.

8. The air-conditioning apparatus of claim 1, further comprising a controller that enables operation in a heating only operation mode, in which all of the plurality of heating/cooling units heat the heat medium and operation in a cooling only operation mode, in which all of the plurality of heating/cooling units cool the heat medium, the controller controlling, in the heating only operation mode and the cooling only operation mode, a heat medium flow switching device corresponding to an indoor unit in operation to switch such that the heat medium from all circulation passages flows into and flows out of the corresponding use side heat exchanger.

9. The air-conditioning apparatus of claim 2, the heat exchangers related to heat medium comprising:

a heat exchanger related to heat medium for heating that heats the heat medium;

and a heat exchanger related to heat medium for cooling that cools the heat medium, wherein the heat medium is made to circulate among the heat exchanger related to heat medium for heating and one or some of the plurality of use side heat exchangers, the heat medium is made to circulate among the heat exchanger related to heat medium for cooling and one or some of the remaining use side heat exchangers, and a cooling and heating mixed operation is performed in the plurality of the indoor units.

10. The air-conditioning apparatus of claim 1 wherein a circumference of the pressure equalizer pipe is smaller than a circumference of a pipe that interconnects the heat medium relay unit and each of the indoor units.

* * * * *